US011766149B2

(12) United States Patent
Sisto

(10) Patent No.: US 11,766,149 B2
(45) Date of Patent: Sep. 26, 2023

(54) ROD ASSEMBLY, BRACKET SYSTEM FOR SUPPORTING A SUPPORT ROD, AND METHOD OF MOUNTING THE SAME ON A SUPPORT STRUCTURE

(71) Applicant: Salto, LLC, Philadelphia, PA (US)

(72) Inventor: Salvatore Sisto, Bradley Beach, NJ (US)

(73) Assignee: Salto, LLC

( * ) Notice: Subject to any disclaimer, the term of this patent is extended or adjusted under 35 U.S.C. 154(b) by 378 days.

(21) Appl. No.: 17/095,850

(22) Filed: Nov. 12, 2020

(65) Prior Publication Data

US 2022/0142390 A1 May 12, 2022

(51) Int. Cl.

| | |
|---|---|
| ***A47H 1/00*** | (2006.01) |
| ***A47H 1/142*** | (2006.01) |
| ***A47K 3/38*** | (2006.01) |
| ***A47H 1/022*** | (2006.01) |
| *A47H 1/02* | (2006.01) |

(52) U.S. Cl.

CPC ..... *A47H 1/142* (2013.01); *A47H 1/022* (2013.01); *A47K 3/38* (2013.01); *A47H 2001/0215* (2013.01); *A47K 2201/02* (2013.01)

(58) Field of Classification Search

None

See application file for complete search history.

(56) References Cited

U.S. PATENT DOCUMENTS 905,142 A * 12/1908 Bond ..... A47H 1/022 182/228.1
917,772 A * 4/1909 Laun ..... A47H 1/142 248/262
953,912 A * 4/1910 Laun ..... A47H 1/142 248/262
1,553,132 A * 9/1925 Bertrand ..... A47G 25/06 248/251
3,749,344 A 7/1973 Racina
4,700,918 A 10/1987 Andrasko
(Continued)

FOREIGN PATENT DOCUMENTS

| | | |
|---|---|---|
| CA | 2804541 | 8/2013 |
| TW | M506565 | 8/2015 |

OTHER PUBLICATIONS https://www.amazon.com/Hysagtek-Support-Supports-Stainless-Diameter/dp/B07F8F92PV/ref=sr_1_35?dchild=1&keywords=shower+rod+cap&qid=.

https://www.hafele.com/us/en/product/round-wardrobe-tube-with-supports-tag-synergy-collection/000000bc00018b1600030023/.

*Primary Examiner* — Steven M Marsh
(74) *Attorney, Agent, or Firm* — BELLES KATZ LLC

(57) ABSTRACT

A bracket system for mounting a support rod, such as a closet rod, a shower curtain rod, a towel bar, or the like, between two support surfaces. The bracket system includes a bracket member and a cover member. The bracket member includes a base portion and a rod support member. The rod support member includes a support portion that supports the support rod and a spring portion that facilitates coupling of the bracket member to the cover member. The spring portion is compressed or deformed and then the cover member is slid over the spring portion. Upon release of the compression on the spring portion, the spring portion exerts an outward restoring force onto the cover member to couple the cover member to the bracket member. The support rod is supported by the support portion of the rod support member and extends through an opening in the cover member.

20 Claims, 16 Drawing Sheets

(56) References Cited

U.S. PATENT DOCUMENTS

| | | | | |
|---|---|---|---|---|
| 5,022,104 | A | 6/1991 | Miller | |
| D319,573 | S | 9/1991 | Rogers | |
| 6,845,955 | B1 * | 1/2005 | Hsu | A47K 3/38 248/200.1 |
| 8,806,670 | B2 | 8/2014 | O'Connell | |
| 9,271,593 | B1 | 3/2016 | Chang | |
| 9,554,674 | B2 * | 1/2017 | Forrest | A47K 3/38 |
| 9,949,588 | B1 | 4/2018 | Stine | |
| 10,702,086 | B1 | 7/2020 | Sayed | |
| 11,058,245 | B2 * | 7/2021 | Wright | A47B 61/003 |
| 11,371,283 | B2 * | 6/2022 | Wang | E06B 9/42 |
| 2017/0280942 | A1 | 10/2017 | Fraley | |

* cited by examiner

ROD ASSEMBLY, BRACKET SYSTEM FOR SUPPORTING A SUPPORT ROD, AND METHOD OF MOUNTING THE SAME ON A SUPPORT STRUCTURE

BACKGROUND OF THE INVENTION

There are several locations within a home, hotel, office space, or other building within which it is desirable to hang a support rod. For example, support rods are used in closets for purposes of hanging hangers, support rods are used in bathrooms for holding shower curtains, and support rods are positioned over windows for holding window curtains. Support rods may also be used in an exercise regime, such as acting as the support for a user to perform pull-ups or chin-ups or similar exercise activities. In some situations, such support rods may be mounted to a wall via tension. In other situations, such support rods may be mounted to the wall by supporting the support rods with brackets that are coupled to the wall with fasteners. However, there remains a need for a bracket system that can be used to support such a support rod that provides for a seamless aesthetic appearance and simple installation with a reduced install time.

SUMMARY OF THE INVENTION

The invention may be directed to a bracket system for mounting a support rod, such as one used in a closet or for holding a shower curtain, between two walls, a rod assembly, and a method of mounting a rod assembly to a wall. The bracket system may include a bracket member and a cover member. The bracket member may include a base portion and a rod support member. The rod support member may include s support portion that supports the support rod and a spring portion that facilitates coupling of the bracket member to the cover member. The spring portion is compressed or deformed and then the cover member is slid over the spring portion. Upon release of the compression on the spring portion, the spring portion exerts an outward force onto the cover member to maintain the coupling between the cover member and the bracket member. The support rod is supported by the support portion of the rod support member and extends through an opening in the cover member. In use, there may be two of the bracket members and two of the cover members, each mounted on opposing walls that face one another in a spaced apart manner, with the support rod extending between the two opposing walls.

In one aspect, the invention may be a bracket system for supporting a support rod, the bracket system comprising: a bracket member configured to be mounted to a support structure, the bracket member comprising: a base portion comprising a longitudinal axis, a rear surface that faces the support structure when the bracket member is coupled to the support structure, and a front surface opposite the rear surface; and a rod support member extending from the front surface of the base portion, the rod support member comprising a support portion and first and second spring portions that extend from the support portion on opposite sides of the longitudinal axis of the base portion, the support portion being attached to the front surface of the base portion and the first and second spring portions being unattached to the base portion so that the first and second spring portions can flex relative to the support portion; and a cover member configured for detachable coupling to the bracket member via engagement between the first and second spring portions of the rod support portion of the bracket member and an inner surface of the cover member.

In another aspect, the invention may be a rod assembly for a curtain or closet, the rod assembly comprising: a first bracket member and a second bracket member, each of the first and second bracket members comprising a base portion having a front surface and a rear surface and a rod support member extending from the front surface of the base portion, the rod support member comprising a support portion that is attached to the front surface of the base portion and first and second spring portions that are unattached to the front surface of the base portion, wherein the first bracket member is configured to be coupled to a first wall with the rear surface of the base portion facing the first wall and the second bracket member is configured to be coupled to a second wall with the rear surface of the base portion facing the second wall; a support rod extending between the first and second walls and supported by the support portions of the rod support members of the first and second bracket members; a first cover member and a second cover member positioned around the support rod, each of the first and second cover members comprising a front wall having a hole through which the support rod extends and a sidewall extending from the front wall; and wherein the first cover member is coupled to the first bracket member by compressing the first and second spring members of the first bracket member inwardly towards one another and sliding the first cover member over the rod support member of the first bracket, the first and second spring members of the first bracket member exerting an outward force onto the sidewall of the first cover member to couple the first cover member to the first bracket member; and wherein the second cover member is coupled to the second bracket member by compressing the first and second spring members of the second bracket member inwardly towards one another and sliding the second cover member over the rod support member of the second bracket, the first and second spring members of the second bracket member exerting an outward force onto the sidewall of the second cover member to couple the second cover member to the second bracket member.

In yet another aspect, the invention may be a method of mounting a rod assembly on a wall, the method comprising: attaching a first bracket member to a first wall, a first rod support member of the first bracket member extending from the first wall; attaching a second bracket member to a second wall that is spaced from and parallel to the first wall, a second rod support member of the second bracket member extending from the second wall; sliding a first cover member and a second cover member onto a support rod; positioning the support rod onto support portions of the first and second rod support members so that the support rod extends between the first and second walls; compressing a spring portion of the first rod support member and sliding the first cover member towards the first bracket member until the spring portion of the first rod support member nests within a first cavity of the first cover member, the spring portion of the first rod support member exerting an outward force onto the first cover member to couple the first cover member to the first bracket member; and compressing a spring portion of the second rod support member and sliding the second cover member towards the second bracket member until the spring portion of the second rod support member nests within a second cavity of the second cover member, the spring portion of the second rod support member exerting an outward force onto the second cover member to couple the second cover member to the second bracket member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
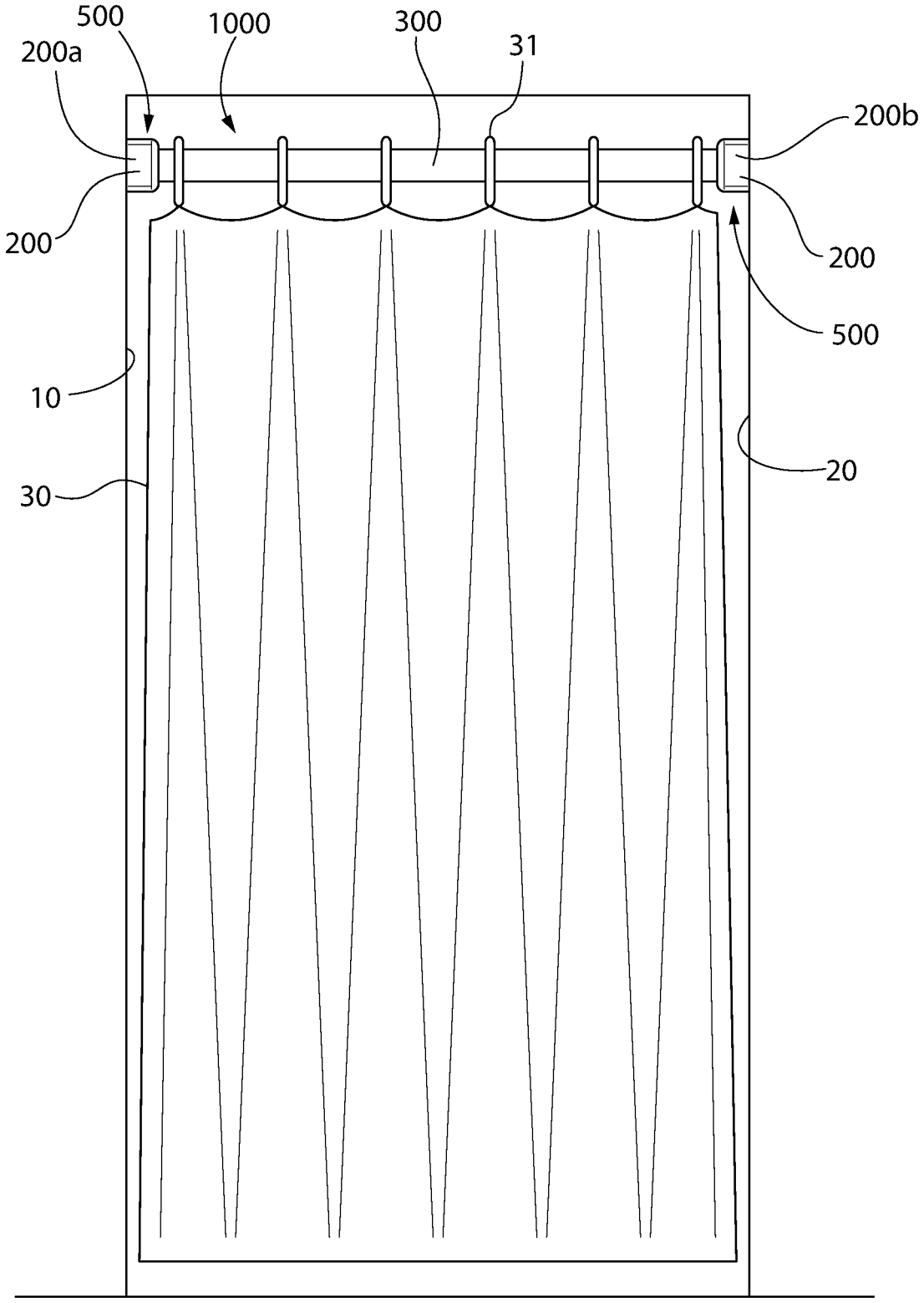
FIG. 1 is a front view of a rod assembly supporting a shower curtain in accordance with an embodiment of the present invention.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE INVENTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "connected," "coupled," "interconnected," and similar refer to a relationship wherein structures are secured or attached to one another either directly or indirectly through intervening structures, as well as both movable or rigid attachments or relationships, unless expressly described otherwise. The term "fixed" refers to two structures that cannot be separated without damaging one of the structures. The term "filled" refers to a state that includes completely filled or partially filled.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 13:
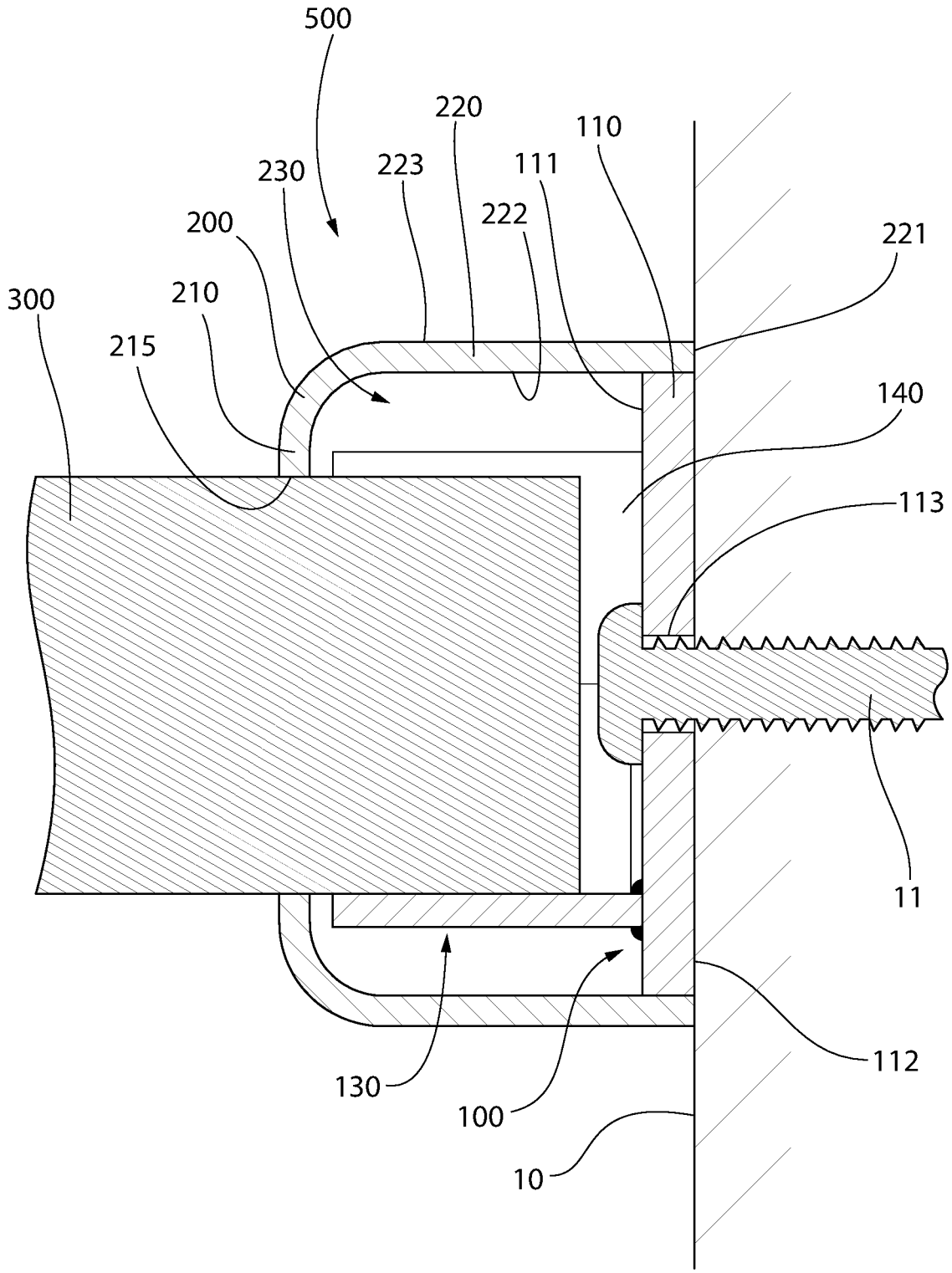
FIG. 13 is a cross-sectional view taken along line XIII-XIII of FIG. 12.

Referring first to FIGS. 1 and 13, a rod assembly 1000 is illustrated mounted within a bathroom between two spaced apart and parallel walls. The rod assembly 1000 generally comprises a bracket member 100, a cover member 200, and a support rod 300. More specifically, the rod assembly 1000 comprises two of the bracket members 100, two of the cover members 200, and one support rod 300. When the rod assembly 1000 is fully installed within a room as shown in FIGS. 1 and 13, each of the bracket members 100 is paired with and attached to one of the cover members 200 to form a bracket system 500. That is, the bracket system 500 comprises one of the bracket members 100 and one of the cover members 200. The support rod 300 is supported by the two bracket members 100 and extends between the two bracket members 100.

In particular, in the exemplified embodiment the rod assembly 1000 includes a first bracket member **100*a* coupled to a first wall 10 and a second bracket member 100*b* coupled to a second wall 20. The first and second walls 10, 20 are oriented generally parallel to one another and are spaced apart. While described as being generally parallel, the first and second walls 10, 20 could be at slight angles relative to one another, in particular if the first and second walls 10, 20 are not perfectly vertically oriented (i.e., plumb). The rod assembly 1000 also includes a first cover member 200*a* coupled to the first bracket member 100*a* and a second cover member 200***b* coupled to the second bracket member 100*b*. Finally, the support rod 300 is supported by the first and second bracket members 100*a*, 100*b*, extends through the first and second cover members 200*a*, 200*b*, and extends between the first and second walls 10, 20. The cover members 200*a*, 200*b* cover the bracket members 100*a*, 100*b* from view to provide for a clean and desirable aesthetic. The bracket members 100*a*, 100*b* perform the function of supporting the support rod 300. In the exemplified embodiment, the cover members 200*a*, 200*b* do not support the support rod 300.

In the exemplified embodiment, the bracket members 100 are coupled to the first and second walls 10, 20. However, the invention is not to be so limited and the bracket members 100 need not be coupled to a wall in all embodiments. Rather, the bracket members 100 may be configured to be coupled to or mounted on a support structure, which may include walls, bookshelves, cabinets, dressers, doors, desks, other furniture items, or any other type of structure to which it may be possible to couple the bracket members 100. In some embodiments, the bracket members 100 may be secured across a bottom of a cubby member which includes various cubbies or cubicles for holding towels or other items, and the support rod which extends between the bracket members 100 may be used as a towel bar or the like. The system could also be mounted between the legs of a sink vanity, between a vanity and an adjoining wall, or in various other situations. Moreover, when the support structure is two walls, the two walls may be covered by tiles or other components in some embodiments.

In the exemplified embodiment, the rod assembly 1000 is located within a bathroom and the support rod 300 extends across a shower or bathtub and supports a shower curtain 30. That is, the shower curtain 30 includes connection members 31 that at least partially wrap around the support rod 300 and then the remainder of the shower curtain 30 hangs from the support rod 300 downwardly towards the floor. However, the invention should not be limited to use of the rod assembly 1000 in a bathroom for purposes of supporting a shower curtain. In other embodiments, the rod assembly 1000 may be used along the top of a window so that the support rod 300 supports a window curtain. In still other embodiments, the rod assembly 1000 may be used in a closet so that the support rod 300 supports hanging articles of clothing by hangers (coats, sweaters, shirts, pants, etc.). Generally, the rod assembly 1000 is used in any space where it may be desired to mount a support rod between two walls or between two support structures for purposes of hanging curtains, clothing, or other items from the support rod. The rod assembly 1000 may also be used as an exercise tool such that the support rod 300 may be used as a wall mounted pull-up bar or the like.

Figure 2:
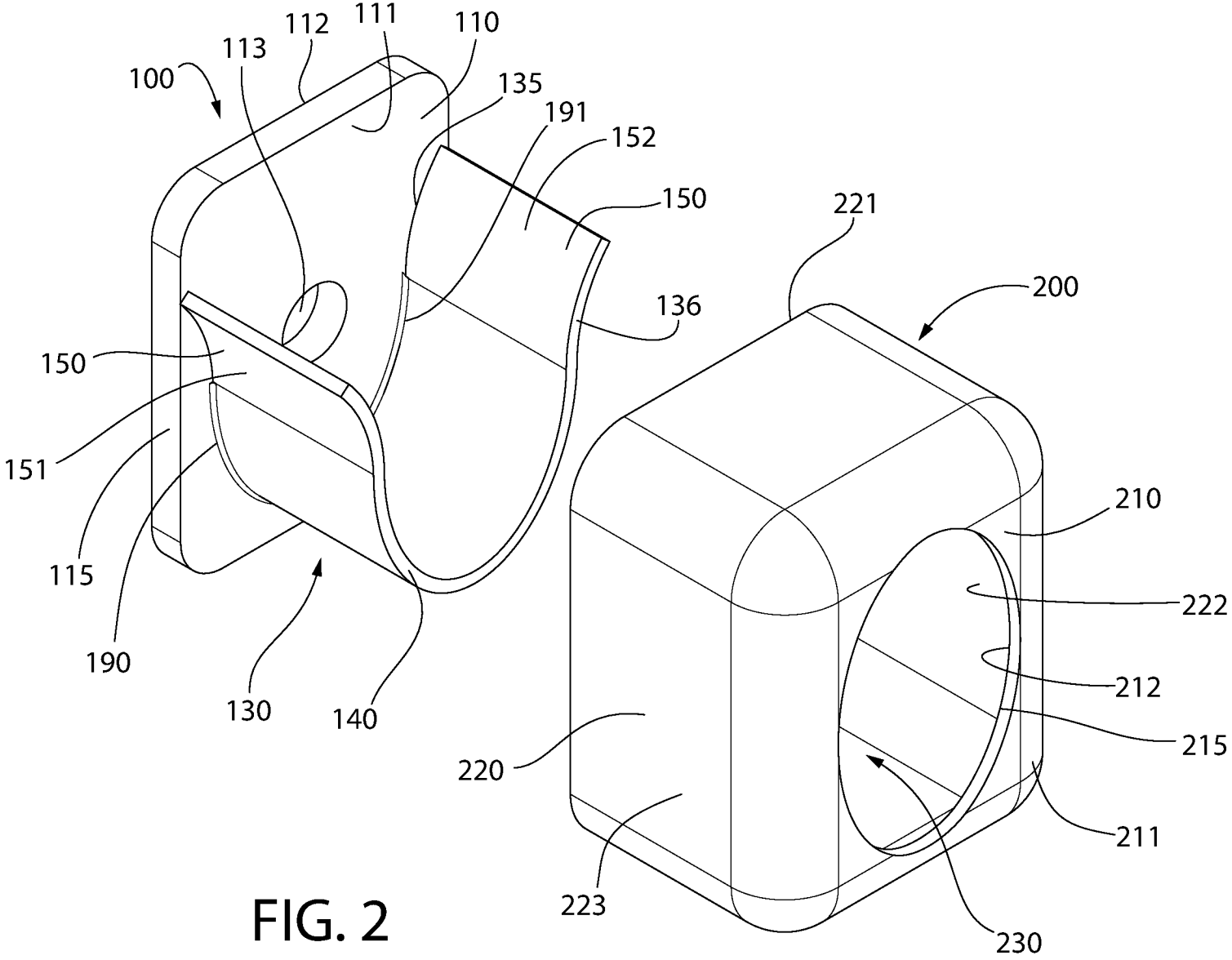
FIG. 2 is a perspective view of a bracket system of the rod assembly of FIG. 1, wherein the bracket member includes a bracket member and a cover member shown in a detached state.

Referring to FIG. 2, the bracket system 500 which comprises the bracket member 100 and the cover member 200 will be briefly described. The bracket member 100 comprises a base portion 110 having a front surface 111 and a rear surface 112 opposite the front surface 111. When the bracket member 100 is coupled to a support structure such as a wall, the rear surface 112 of the base portion 110 of the bracket member 100 faces the wall and the front surface 111 of the base portion 110 of the bracket member 100 faces away from the wall. The rear surface 112 of the base portion 110 of the bracket member 100 is therefore flat and planar in the exemplified embodiment. The front surface 111 is also flat and planar and parallel to the rear surface 112 in the exemplified embodiment. The base portion 110 of the bracket member 100 comprises a mounting hole 113 in the exemplified embodiment. The mounting hole 113 is an aperture that extends entirely through the thickness of the base portion 110 of the bracket member 100 from the front surface 111 to the rear surface 112. Thus, a fastener such as a screw, a nail, a bolt, or the like can extend through the mounting hole 113 for purposes of coupling the bracket member 100 to a support structure such as a wall.

Furthermore, the bracket member 100 comprises a rod support member 130 extending or protruding from the front surface 111 of the base portion 110 of the bracket member 100. The rod support member 130 serves a dual purpose. First, the rod support member 130 supports the support rod 300 as will be described in greater detail below. Second, the rod support member 130 has a spring feature which facilitates the coupling between the bracket member 100 and the cover member, as will also be described in greater detail below. In that regard, the rod support member 130 comprises a support portion 140 and a spring portion 150. The rod support member 130 supports the support rod 300 and the spring portion 150 achieves the coupling between the bracket member 100 and the cover member 200.

In the exemplified embodiment, the base portion 110 of the bracket member 100 is a singular monolithic component and the rod support member 130 of the bracket member 100 is a singular monolithic component which is distinct from the base portion 110. The rod support member 130 is coupled to the base portion 110 in a separate step in the manufacturing process, rather than the bracket member 100 being an integral structure. That is, the base portion 110 of the bracket member 100 is one component part and the rod support member 130 of the bracket member 100 is another component part, and the rod support portion 130 is fixedly attached to the base portion 110 during the manufacturing process, as described further below. In some embodiments the base portion 110 and the rod support member 130 may be formed from metal, such as aluminum, steel (including stainless steel), or the like. However, the invention is not to be so limited in all embodiments and the base portion 110 and the rod support member 130 may be formed from plastic in other embodiments.

The cover member 200 comprises a front wall 210 having a front surface 211 and a rear surface 212 and a sidewall 220 that extends from the rear surface 212 of the front wall 210 to a distal end 221. The front wall 210 comprises an opening or aperture 215 that extends from the front surface 211 to the rear surface 212. When the bracket system 500 is used to support a support rod as described herein, the support rod is configured to extend through the opening or aperture 215 in the front wall 210 of the cover member 200.

In the exemplified embodiment, the sidewall 220 is an annular sidewall such that the sidewall 220 and the front wall 210 collectively define a cavity 230 of the cover member 200 that has an opening at the distal end 221 of the sidewall 220. More specifically, the sidewall 220 has an inner surface 222 and an outer surface 223, and the inner surface 222 of the sidewall 220 and the rear surface 212 of the front wall 210 collectively define the cavity 230. The cavity 230 is configured to receive the bracket member 100 when the cover member 200 is coupled to the bracket member 100. Thus, when in use, the cover member 200 covers the bracket member 100 and hides the bracket member 100 from view to give the bracket system 500 a clean aesthetic appearance. The bracket member 100 may be wholly or partially disposed within the cavity 230 of the cover member 200 when the cover member 200 is coupled to the bracket member 100. In the exemplified embodiment, the bracket member 100 is wholly disposed within the cavity 230 of the cover member 200 when they are coupled.

Figure 3:
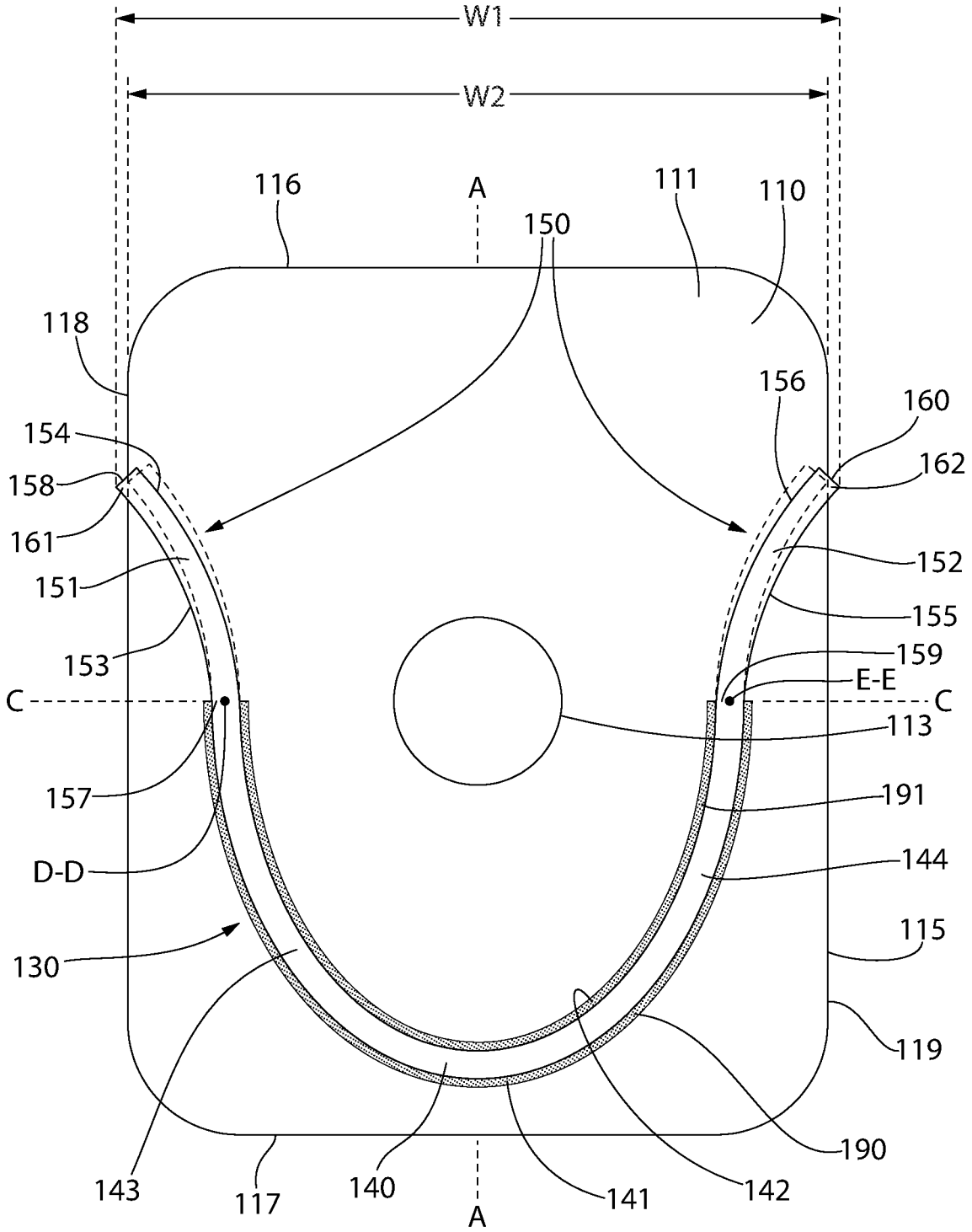
FIG. 3 is a front view of the bracket member of the bracket system of FIG. 2 wherein movement of a spring portion of a rod support member of the bracket member is depicted in broken lines.

Referring now to FIGS. 2 and 3, the bracket member 100 will be further described. The rod support member 130 is a generally U-shaped member in the exemplified embodiment, although this is not required in all embodiments. The rod support member 130 may take on a more square or rectangular or triangular-like shape in other embodiments. In the exemplified embodiment, the base portion 110 of the bracket member 100 comprises a peripheral or outer edge 115 comprising a top edge portion 116, a bottom edge portion 117, a first side edge portion 118, and a second side edge portion 119. The base portion 110 extends along a longitudinal axis A-A from the bottom edge portion 117 to the top edge portion 116.

In the exemplified embodiment, the base portion 110 has a square or rectangular shape (although with rounded corners). The invention is not to be so limited in all embodiments and the base portion 110 could be round or could have other polygonal shapes in other embodiments. In embodiments whereby the base portion 110 is round rather than polygonal, the base portion 110 still comprises the top, bottom, first side, and second side edge portions 116, 117, 118, 119. Specifically, the top, bottom, first side, and second side edge portions 116, 117, 118, 119 are merely portions of the periphery our outer edge 115 of the base portion 110 which exists between the front and rear surfaces 111, 112. Thus, when the base portion 110 is a circle in shape, the top region of the peripheral edge is the top edge portion 116, and so on.

The support portion 140 of the rod support member 130 is generally U-shaped and comprises a convex lower surface 141 that faces the bottom edge portion 117 of the base portion 110 and a concave upper surface 142 that faces the top edge portion 116 of the base portion 110. The concave upper surface 142 defines a nesting region within which a portion of the support rod 300 can nest when the bracket member 100 is supporting the support rod 300. As noted, although the support portion 140 of the rod support member 130 is generally U-shaped in the exemplified embodiment, the support portion 140 could have a more square-like, rectangular-like, triangular-like, or other shape in other embodiments so long as it is configured to support the support rod 300 as described herein.

The spring portion 150 of the rod support member 130 comprises a first spring portion 151 located on a first side of the longitudinal axis A-A and a second spring portion 152 located on a second side of the longitudinal axis A-A. Stated another way, the support portion 140 comprises a first portion 143 located on a first side of the longitudinal axis A-A and a second portion 144 located on a second side of the longitudinal axis A-A. The first spring portion 151 extends from the first portion 143 of the support portion 140 and the second spring portion 152 extends from the second portion 144 of the support portion 140. As noted above, the rod support member 130 is an integral, monolithic, unitary structure. Thus, the first and second spring portions 151, 152 extend from and are integrally formed with the support portion 140.

The first spring portion 151 comprises a concave surface 153 that faces the first side edge 118 of the base portion 110 and a convex surface 154 that faces the longitudinal axis A-A. The second spring portion 152 comprises a concave surface 155 that faces the second side edge 119 of the base portion 110 and a convex surface 156 that faces the longitudinal axis A-A. That said, the invention is not to be limited by the specific shapes of the various portions of the rod support member 130 in all embodiments and other shapes and contours may be used so long as the function described herein is still achieved. Thus, the first and second spring portions 151, 152 could have convex surfaces that face the first and second end portions 118, 119 while still achieving the same function, which is to facilitate the coupling between the bracket member 100 and the cover member 200, as will be described in more detail below.

As noted above, the rod support member 130 is joined to or coupled to or attached to the front surface 111 of the base portion 110 of the bracket member 100. However, an important feature of the invention described herein is the manner in which the rod support member 130 is attached to the front surface 111 of the base portion 110. Particularly, the rod support member 130 is joined (or fixed) to the front surface 111 of the base portion 110 along the support portion 140 thereof, but not along the spring portion 150 thereof. That is, the first and second spring members 151, 152 are not in any way directly attached to the base portion 110. In the exemplified embodiment of FIG. 3, the rod support member 130 is welded to the front surface 111 of the base portion 110 along the support portion 140 thereof, but remains unattached to the front surface 111 of the base portion 110 along the spring portion 150 (i.e., the first and second spring portions 151, 152) thereof. In FIGS. 2 and 3, there is a weld 190 located along the convex lower surface 141 of the support portion 140 and a weld 191 located along the concave upper surface 142 of the support portion 140. However, in other embodiments there may be the weld 190 and not the weld 191, or just the weld 191 and not the weld 190. Thus, there exists a transverse axis C-C that is transverse to the longitudinal axis A-A which intersects the rod support portion 130 at the junction between the support portion 140 and the spring portion 150. The rod support portion 130 is fixed or joined to the base portion 110 below the transverse axis C-C and is not fixed or joined to (i.e., is unattached) the base portion 110 above the transverse axis C-C.

The rod support member 130 comprises a rear surface 135 which is joined to the front surface 111 of the base portion 110 along the support portion 140 thereof and a front surface 136 opposite the rear surface 135. The rear surface 135 of the rod support member 130 is not joined or otherwise fixed or attached to the front surface 111 of the base portion 110 along the first and second spring portions 151, 152 thereof. The rear surface 135 of the rod support member 130 along the first and second spring portions 151, 152 may be in contact with or slightly spaced from the front surface 111 of the base portion 110, but there is no direct coupling in those regions. The front surface 136 of the rod support member 130 is located at the distal end of the rod support member 130 and is a continuous, seamless surface along both the support portion 140 and the spring portion 150 thereof. Thus, the front surface 136 of the rod support member 130 is a flush, planar surface and there are no shoulders, projections, or the like particularly at the junction of the support portion 140 thereof with the spring portion 150 thereof.

As noted above, the first and second spring portions 151, 152 of the rod support member 130 are not in any way attached to the base portion 110. Thus, the welds 190, 191 stop at the junction of the first and second spring portions 151, 152 with the support portion 140. As a result, the first and second spring portions 151, 152 are free to flex and move (or distort) relative to the base portion 110 and relative to the support portion 140 of the rod support member 130 which remains joined to the base portion 110. This flexing/movement of the first and second spring portions 151, 152 is shown in FIG. 3. In particular, the first and second spring portions 151, 152 are shown in their natural, non-compressed state in solid lines and are shown in their compressed state in dashed lines. A user can apply an inward force onto the spring portions 151, 152 in the direction of the longitudinal axis A-A to cause the first and second spring portions 151, 152 to move inwardly towards one another or outwardly away from one another. When compressed, the first and second spring portions 151, 152 will continually attempt to return to their original, non-compressed state due to their elastic potential energy or spring force. The amount of the elastic potential energy is dependent on the amount or degree to which they first and second spring portions 151, 152 are compressed.

Due to the fact that the first and second spring portions 151, 152 of the rod support member 130 are not joined, affixed, or attached to the base portion 110, the first and second spring portions 151, 152 each forms a cantilever that is fixed at one end and free at the other end. Specifically, the first spring portion 151 extends from a first end 157 to a second end 158. The first end 157 is integral with and extends seamlessly from the support portion 140 and the second end 158 is the distal end. The first spring portion 151 forms a cantilever from the first end 157 to the second end 158 because the first spring portion 151 is free of attachment to any other structure (including specifically the base portion 110) at any location other than its attachment to the support portion 140 at the first end 157. The second spring portion 152 similarly extends from a first end 159 to a second end 160. The first end 159 is integral with and extends seamlessly from the support portion 140 and the second end 160 is the distal end. The second spring portion 152 forms a cantilever from the first end 159 to the second end 160 because the second spring portion 152 is free of attachment to any other structure (including specifically the base portion 110) at any location other than its attachment to the support portion 140 at the first end 159.

As noted above, the first and second spring portions 151, 152 are alterable from the non-compressed state (shown in solid lines in FIG. 3) to the compressed state (shown in dashed lines in FIG. 3) by application of a force on the first and second spring portions 151, 152 in a direction towards the longitudinal axis A-A. That is, if a user applies a force onto the first and second spring portions 151, 152 in a direction towards the longitudinal axis A-A, the first and second spring portions 151, 152 will flex or bend towards the longitudinal axis A-A. However, it is noted that the first and second spring portions 151, 152 are elastic bodies that recover their original shape when released after being distorted. Thus, after altering the first and second spring portions 151, 152 into the compressed state, upon cessation of the force thereon, the first and second spring portions 151, 152 will automatically recover back to their natural, uncompressed state or position. Moreover, while the compression force is being applied onto the first and second spring portions 151, 152, the first and second spring portions 151, 152 exert an outward restoring force as they attempt to recover to their original shape and position. This action of the first and second spring portions 151, 152 is used to couple the cover member 200 to the bracket member 100 as will be described in greater detail below.

In the exemplified embodiment, when in the non-compressed and natural state, the first spring portion 151 comprises a distal portion 161 that protrudes beyond the first side edge portion 118 of the base portion 110. Similarly, when in the non-compressed and natural state, the second spring portion 152 comprises a distal portion 162 that protrudes beyond the second side edge portion 119 of the base portion 110. The first and second spring portions 151, 152 are configured to be compressed into the compressed state, and in the compressed state the distal portions 161, 162 of the first and second spring portions 151, 152 do not protrude from the first and second side edge portions 118, 119 of the base portion 110. That is, in the compressed state no portion of the first and second spring portions 151, 152 protrudes from or beyond the peripheral edge of the base portion 110.

As a result of this, and as will be described in even greater detail below, the cover member 200 is unable to be coupled to the bracket member 100 when the first and second spring portions 151, 152 are in the non-compressed state. Specifically, when the cover member 200 is coupled to the bracket member 100 in accordance with the exemplified embodiment, an entirety of the bracket member 100 including the base portion 110 thereof is disposed within the cavity 230 of the cover member 200 and the distal end 221 of the sidewall 220 of the cover member 200 abuts the support structure (i.e., the wall). Thus, if the distal portions 161, 162 of the first and second spring portions 151, 152 protrude beyond the periphery of the base portion 110, the cover member 200 is unable to be pushed into the fully assembled position. Rather, the first and second spring portions 151, 152 must first be compressed into the compressed state (shown in dashed lines in FIG. 3), and then the cover member 200 can be slid over the rod support member 130 and coupled to the bracket member 100. Once the cover member 200 is slid over the rod support member 130, the first and second spring members 151, 152 will exert an outward force onto the cover member 200 as the first and second spring members 151, 152 attempt to use their elastic potential energy to recover to their non-compressed states. The outward force of the first and second spring members 151, 152 applied onto the cover member 200 is what achieves the coupling between the bracket member 100 and the cover member 200 in accordance with the exemplified embodiment.

Of course, the distal portions 161, 162 of the first and second spring portions 151, 152 need not protrude beyond the outer edge or periphery of the base portion 110 when in the non-compressed state in all embodiments. Particularly, in some embodiments when the cover member 200 is coupled to the bracket member 100, the distal end 221 of the sidewall 220 of the cover member 200 abuts against the front surface 111 of the base portion 110 rather than abutting against the support structure or wall. In such an embodiment, the distal portions 161, 162 of the first and second spring members 151, 152 may not protrude from the outer edge or periphery of the base portion 110 in the non-compressed state, although the function of the first and second spring portions 151, 152 and their interaction with the cover member 200 for purposes of coupling the cover member 200 to the bracket member 100 remains the same as that described above.

When the first and second spring portions 151, 152 are in their natural, non-compressed state, a first width W1 is measured between the distal end 158 of the first spring portion 151 and the distal end 160 of the second spring portion 152 in a direction transverse to the longitudinal axis A-A. Furthermore, when the first and second spring portions 151, 152 are in the compressed state, a second width W2 is measured between the distal end 158 of the first spring portion 151 and the distal end 160 of the second spring portion 152 in a direction transverse to the longitudinal axis A-A. Since the first and second spring portions 151, 152 are moved towards one another in the compressed state, the second width W2 is less than the first width W1. The width measurements noted herein are taken in a direction transverse to the longitudinal axis A-A at the outermost part of the distal ends 158, 160 (specifically, where the distal end 158 intersects the concave surface 153 of the first spring portion 151 and where the distal end 160 intersects the concave surface 155 of the second spring portion 152).

It should be noted that when the first and second spring portions 151, 152 are altered into the compressed state, the first and second spring portions 151, 152 pivot or rotate or deflect relative to the support portion 140 of the rod support member 130 along pivot axes. Specifically, the first spring portion 151 pivots relative to the support portion 140 along a first pivot axis D-D and the second spring portion 152 pivots relative to the support portion 140 along a second pivot axis E-E. The first and second pivot axes D-D, E-E are perpendicular to the longitudinal axis A-A and are located at the junction or intersection of the first and second spring portions 151, 152 with the support portion 140. The transverse axis C-C intersects the first and second pivot axes D-D, E-E.

Figure 4A:
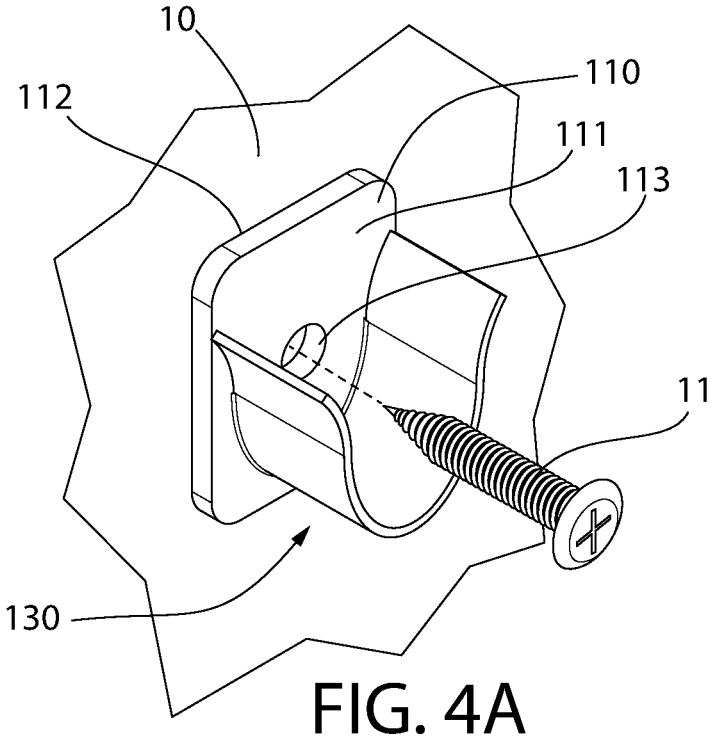
FIGS. 4A and 4B are perspective views illustrating the mounting of the bracket member of the bracket system of FIG. 2 to a wall.
Figure 4B:
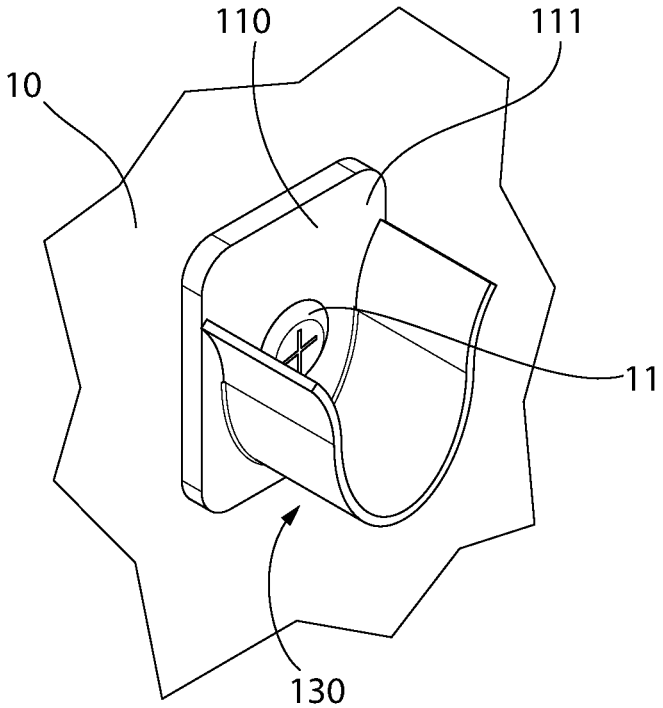

Referring now to FIGS. 4A-12, the process for mounting the bracket system 500 to the support structure (i.e., wall) and assembling the rod assembly 1000 will be described. First, as shown in FIGS. 4A and 4B, the bracket member 100 is positioned with the rear surface 112 of the base portion 110 facing and adjacent to the support structure or wall 10. Next, a fastener 11 is inserted through the mounting hole 113 in the base portion 110 of the bracket member 100 and into the support structure or wall 10 to couple the bracket member 100 to the support structure or wall 10. Of course, a wall anchor may be pre-installed within a hole in the support structure or wall 10 if so desired or if needed. The fastener 11 is a screw in the exemplified embodiment, but could be a nail or other types of fasteners in other embodiments. Moreover, it may alternatively be possible to couple the mounting bracket 100 to the support structure or wall 10 using adhesive, such as adhesive strips, or using hook-and-loop fastener strips, or other such connection techniques.

Generally, the process includes mounting two of the bracket members 100 to two opposing and facing support structures or walls, as shown in FIGS. 1 and 13 and described above. Thus, although the process is being described here with regard to a single one of the bracket members 100, in actual practice and use the identical steps will take place with a second bracket member 100 on a support structure or wall that faces the support structure or wall 10 so that the support rod 300 can extend between the two support structures or walls as shown in FIGS. 1 and 13.

Figure 5A:
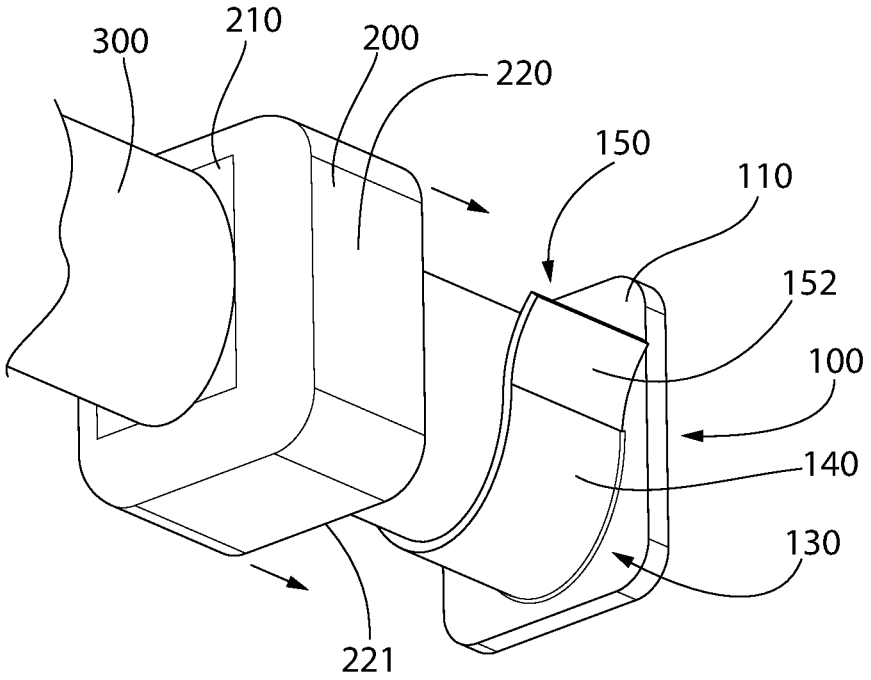
FIGS. 5A-6B are front and rear perspective views illustrating a support rod being supported by the rod support member of the bracket member with the cover member being slid towards the bracket member for coupling therewith.
Figure 5B:
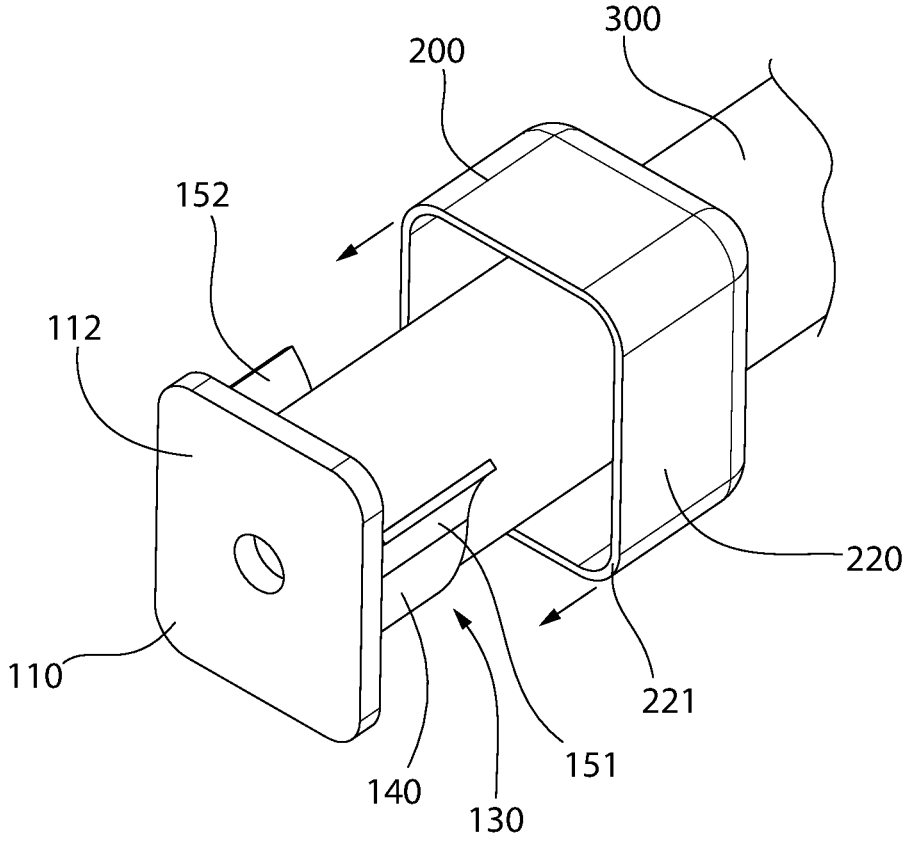

Next, referring to FIGS. 5A and 5B, the cover members 200 are slid onto the support rod 300 by inserting the support rod 300 through the opening 215 in the front wall 210 of the cover member 200. The cover members 200 are slid onto the support rod 300 so that the distal end 221 of the sidewall 220 faces the end of the support rod 300 which is closest to the cover member 200 and faces the bracket member 100 to which the cover member 200 will be coupled in a later step in the process. Although only one cover member 200 is illustrated in FIGS. 5A and 5B, in actual practice two of the cover members 200 are slid onto the support rod 300 with their front walls 210 facing each other to attach to the two bracket members 100 which are already attached to the walls as described herein. When the cover members 200 are slid onto the support rod 300, the cover members 200 are capable of sliding along the support rod 300, which is done to couple the cover members 200 to the bracket members 100 as described below.

In the exemplified embodiment, the support rod 300 has an oval shape and the opening 215 in the front wall 210 of the cover member 200 similarly has an oval shape. Of course, the invention is not to be so limited and several variations to this are possible. First, the support rod 300 and/or the opening 215 need not be oval and can take on any shape as may be desired. Furthermore, the shape of the support rod 300 need not match the shape of the opening 215 in all embodiments, so long as the support rod 300 is configured to fit through the opening 215 while permitting the cover member 200 to be slidable along the support rod 300. Thus, the support rod 300 could be square or triangular and the opening 215 could be circular so long as the support rod 300 is configured to fit into and through the opening 215. In other embodiments, the shapes of the support rod 300 and the opening 215 may match and/or correspond with each other (i.e., be the same shape).

Figure 15:
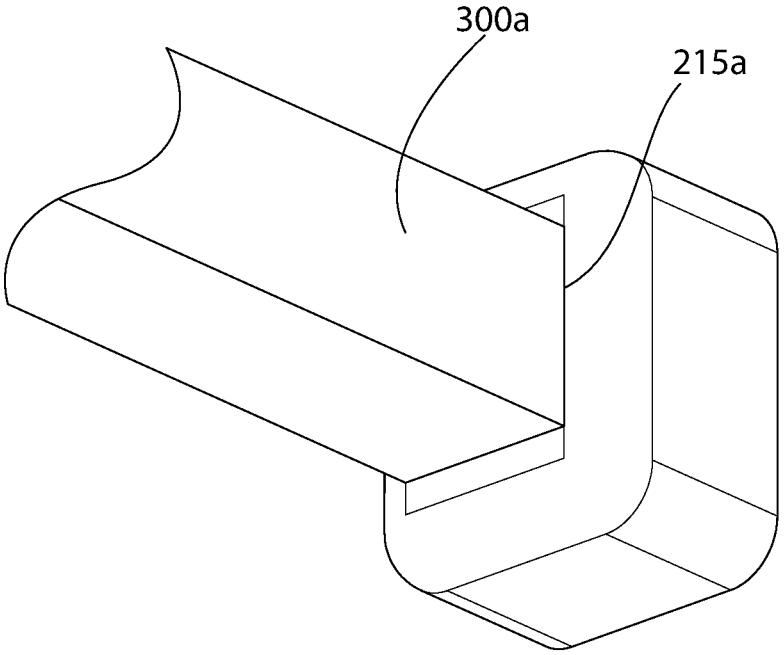
FIG. 15 is a rear perspective view of a bracket system supporting a support rod in accordance with a first alternative embodiment of the present invention.
Figure 16:
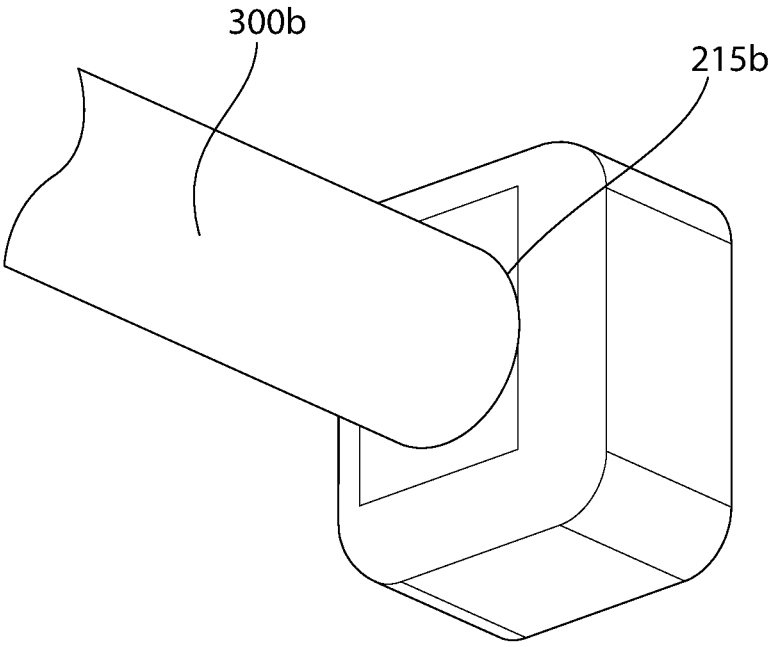
FIG. 16 is a rear perspective view of a bracket system supporting a support rod in accordance with a second alternative embodiment of the present invention.

Referring briefly to FIGS. 15 and 16, embodiments illustrating the support rod 300 having shapes other than an oval are provided. Particularly, in FIG. 15 the support rod 300*a* is square shaped and in FIG. 16 the support rod 300*b* is circular or round rather than being oval. The shape of the opening 215*a*, 215*b* may match the shape of the support rod 300*a*, 300*b* or may be different than the shape of the support rod 300*a*, 300*b* so long as the support rod 300*a*, 300*b* fits through the opening 215*a*, 215*b* as described herein.

Returning to FIGS. 5A and 5B, once the cover members 200 are slid onto the support rod 300, the support rod 300 is positioned so as to rest atop of the support portion 140 of the rod support member 130 of the bracket member 100. As mentioned above, there are two of the bracket members 100 coupled to two opposing walls that face one another. Thus, the support rod 300 should be positioned so as to be supported by the support portions 140 of the rod support members 130 of the two bracket members 100 that have previously been coupled to the walls (see FIGS. 1 and 14, for example). To position the support rod 300 onto the rod support members 130, the support rod 300 is raised above the distal ends 158, 160 of the first and second spring portions 151, 152 of the rod support members 130, moved into alignment with the rod support members 130, and then lowered downwardly until the support rod 300 rests atop of the concave upper surfaces 142 of the support portions 140 of the rod support members 130.

Next, referring to FIGS. 6A-7B, the cover member 200 is slid along the support rod 300 until the distal end 221 of the sidewall 220 of the cover member 200 abuts the front surface 136 of the rod support member 130. Specifically, in FIGS. 6A-7B, the first and second spring portions 151, 152 of the rod support member 130 are in the natural, non-compressed state such that the first width W1 exists between them. Moreover, the cover member 200 extends along a longitudinal axis B-B that is parallel to the longitudinal axis A-A of the base portion 110 of the bracket member 100 when the cover member 200 is coupled to the bracket member 100. The cavity 230 of the cover member 200 has a third width W3 measured in a direction transverse to the longitudinal axis B-B. The third width W3 is less than the first width W1 and greater than the second width W2.

Figure 6A:
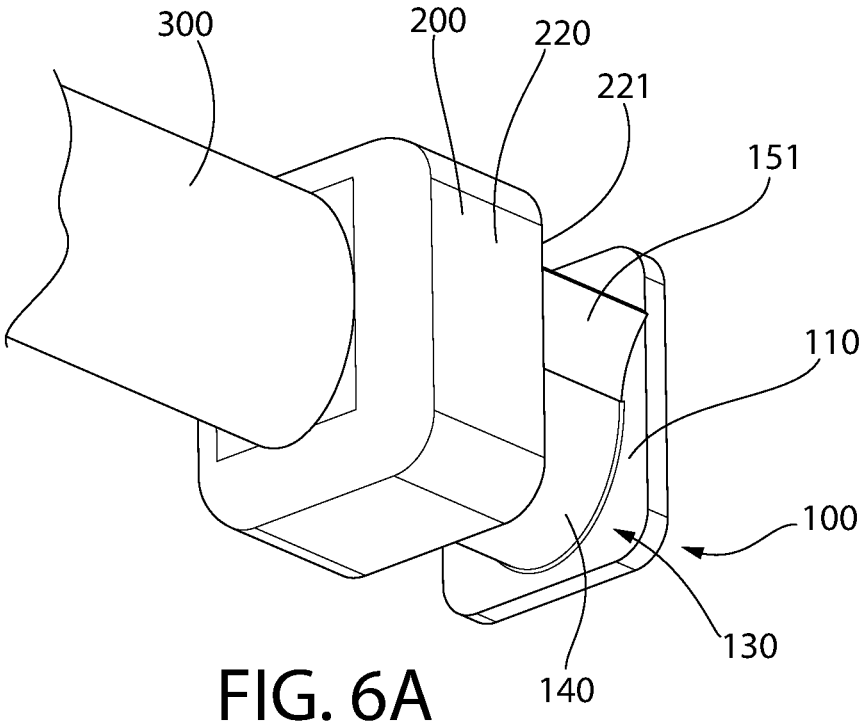
Figure 6B:
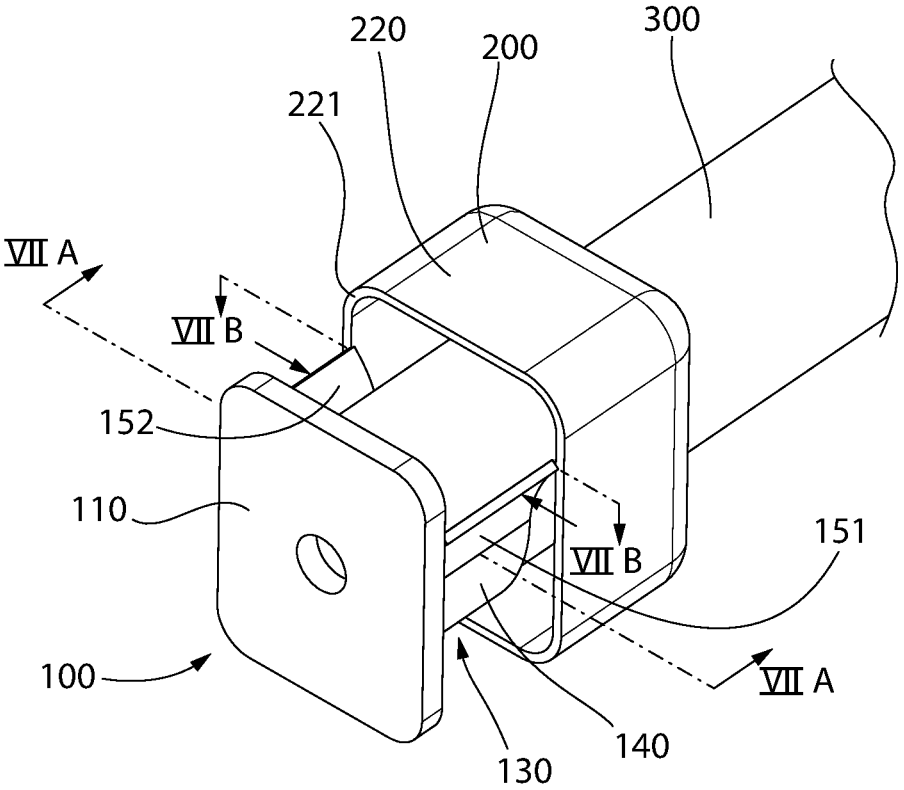
Figure 7A:
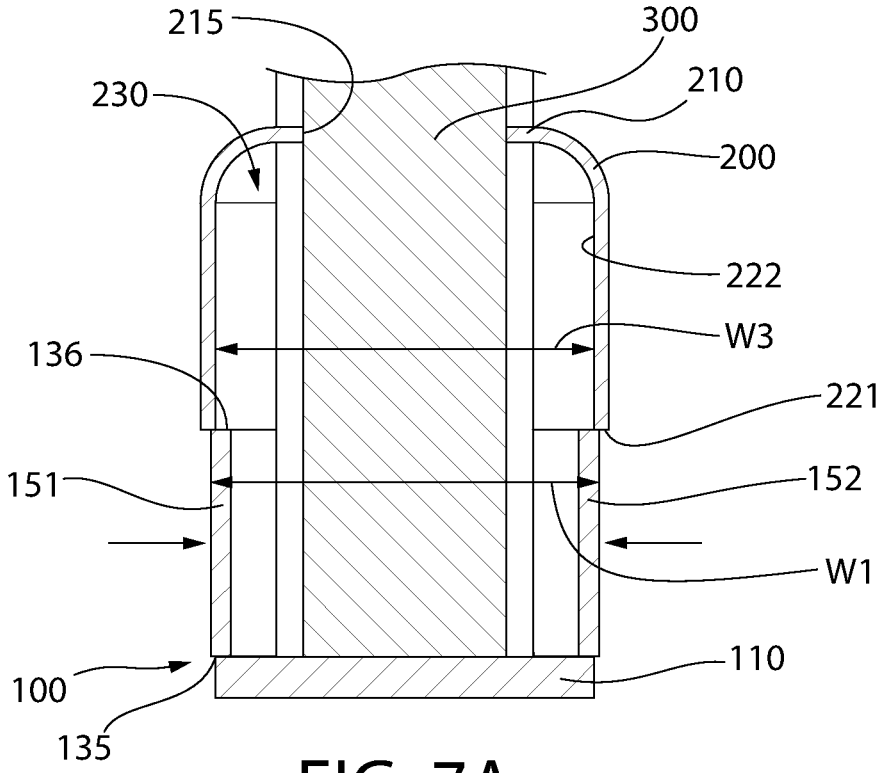
FIG. 7A is a cross-sectional view taken along line VIIA-VIIA of FIG. 6B.
Figure 7B:
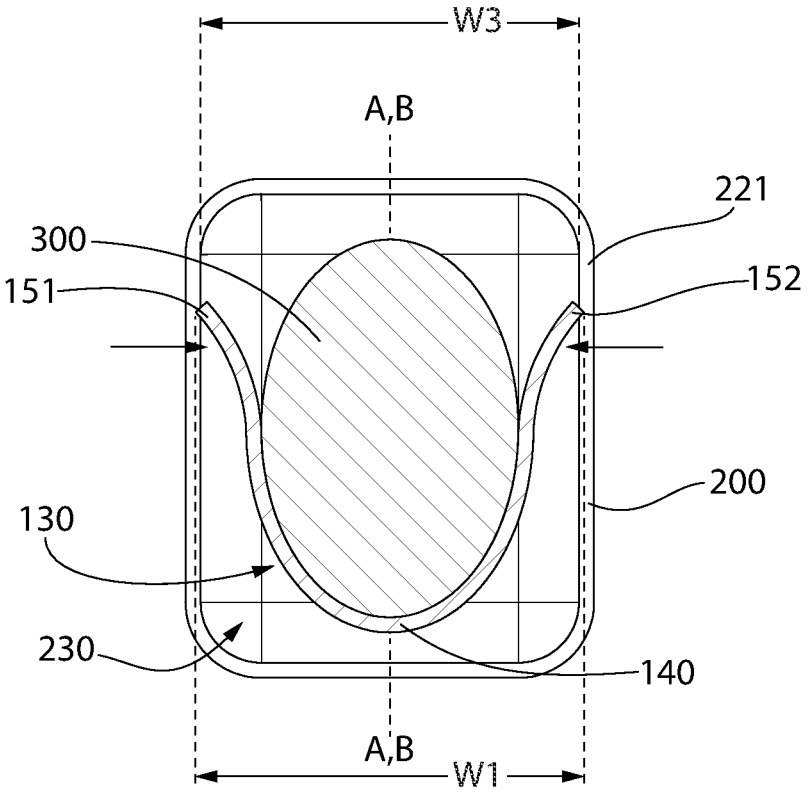
FIG. 7B is a cross-sectional view taken along line VIIB-VIIB of FIG. 6B.
Figure 8A:
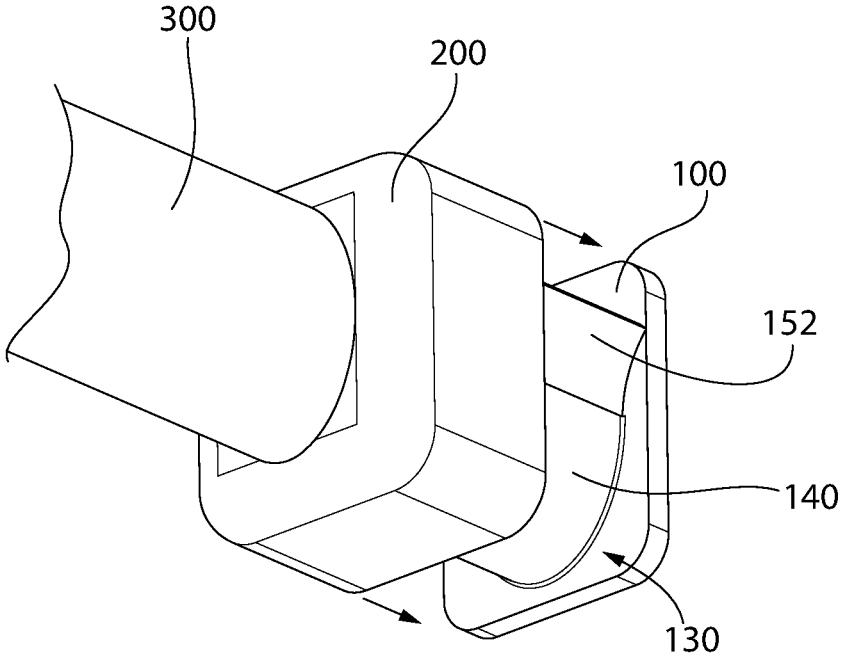
FIGS. 8A and 8B are front and rear respective views illustrating the support rod being supported by the rod support member of the bracket member whereby the cover member has been slid into contact with the spring portions of the rod support member.
Figure 8B:
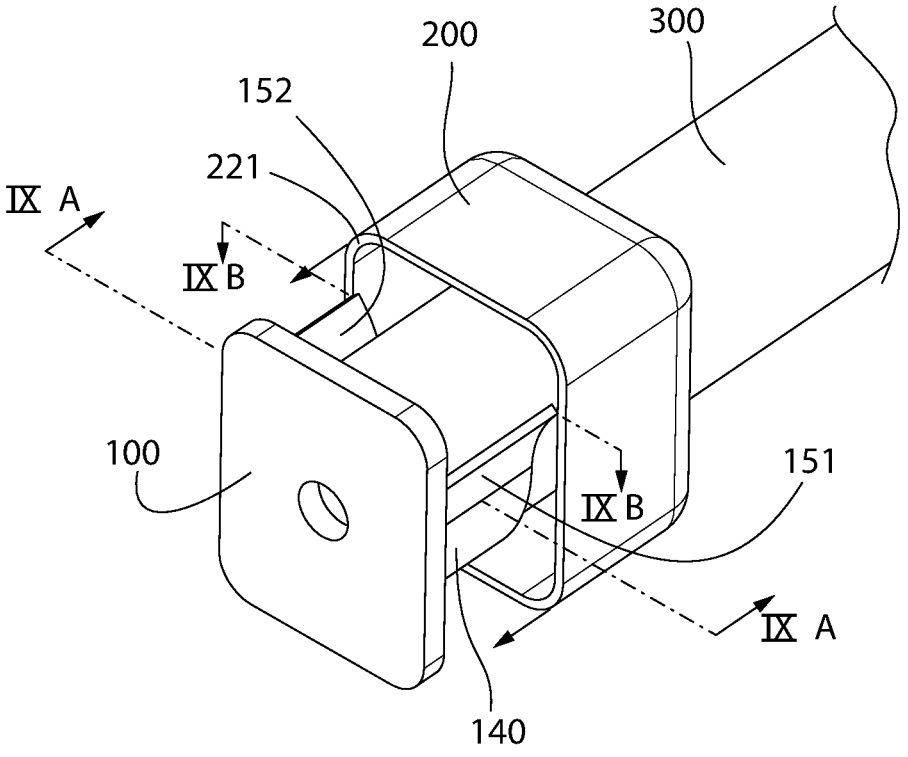
Figure 9A:
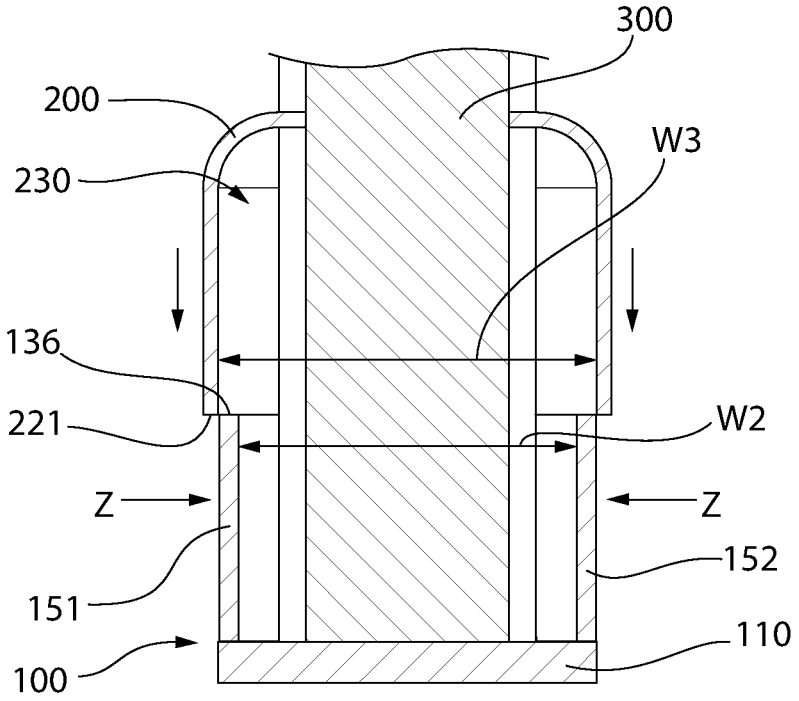
FIG. 9A is a cross-sectional view taken along line IXA-IXA of FIG. 8B.
Figure 9B:
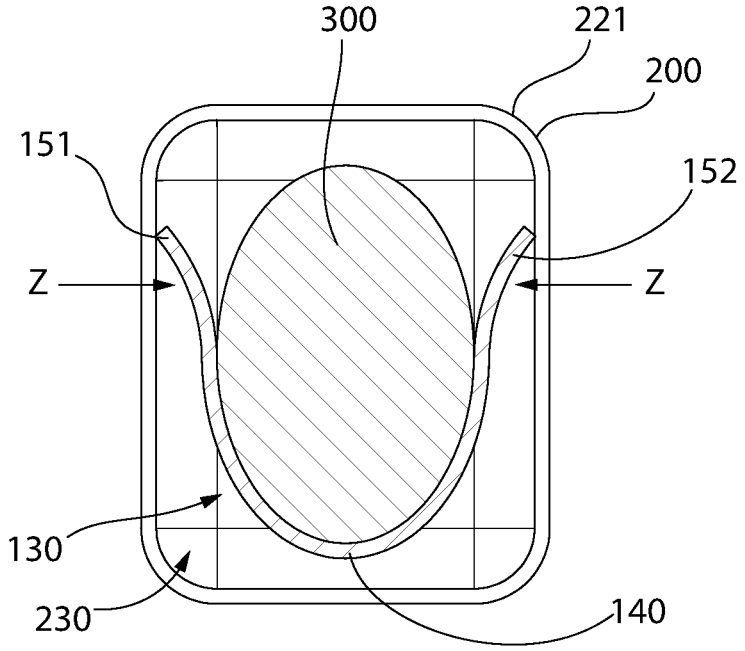
FIG. 9B is a cross-sectional view taken along line IXB-IXB of FIG. 8B.
Figure 10A:
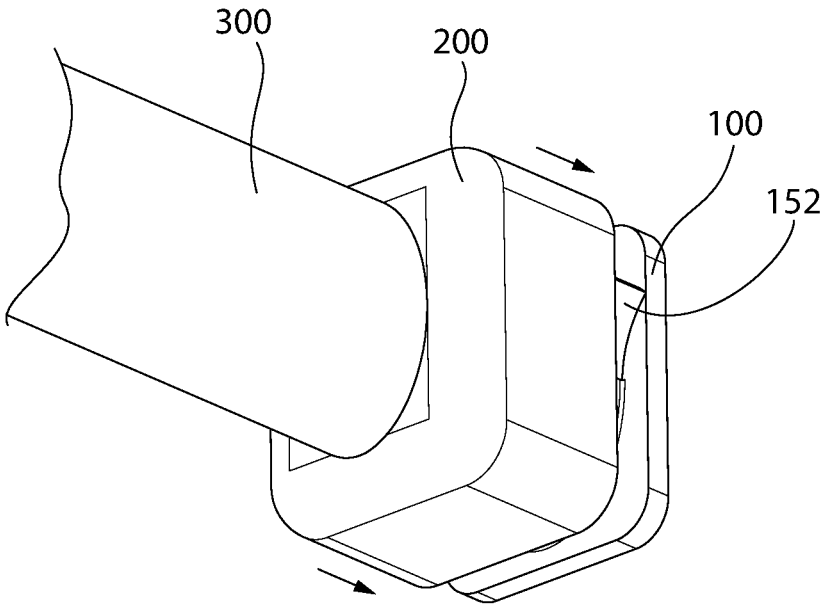
FIGS. 10A and 10B are front and rear respective views illustrating the spring portion of the rod support member being compressed inwardly so that the cover member can be slid thereon.
Figure 10B:
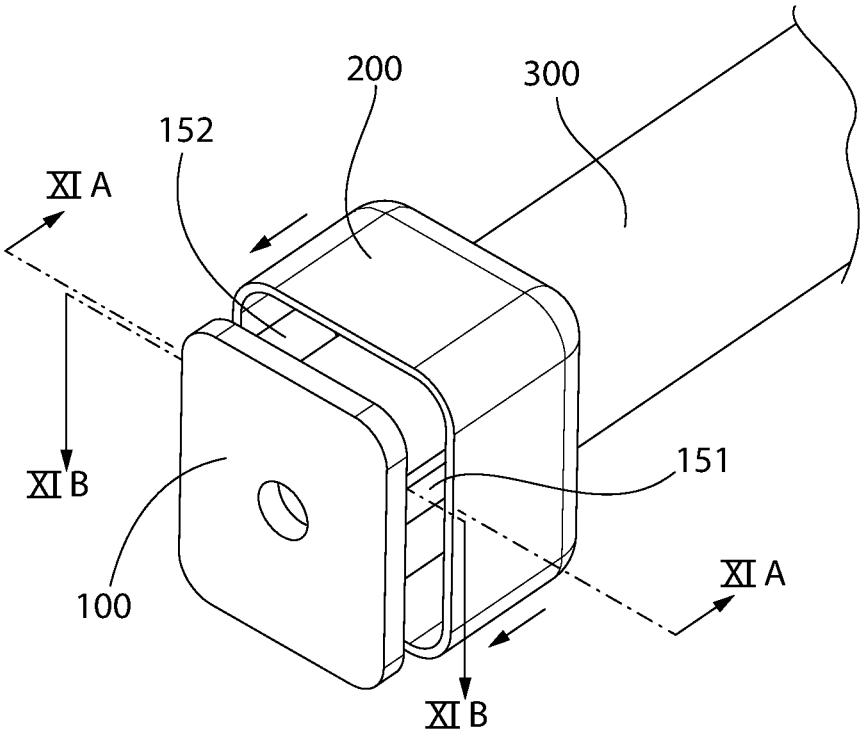
Figure 11A:
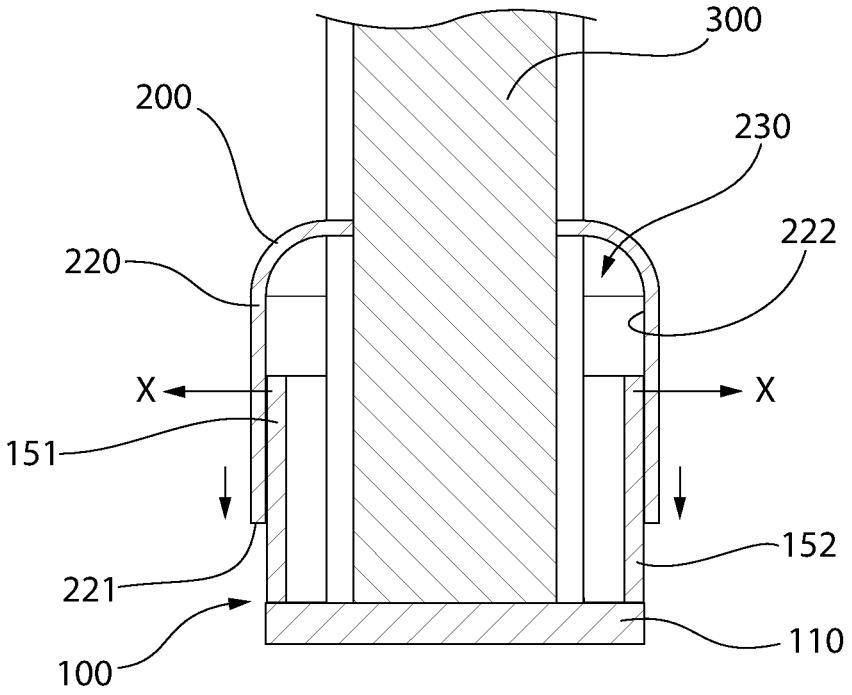
FIG. 11A is a cross-sectional view taken along line XIA-XIA of FIG. 10B.
Figure 11B:
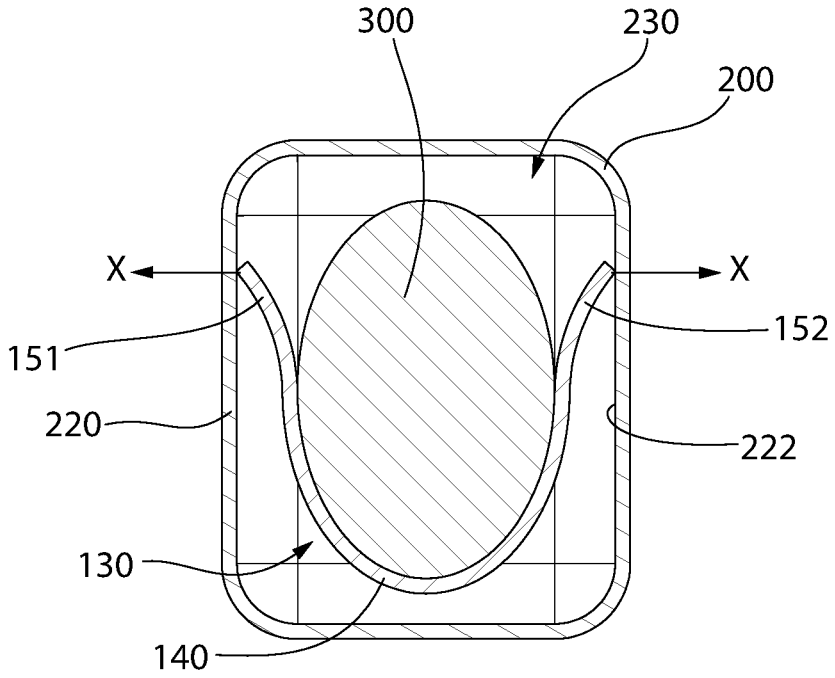
FIG. 11B is a cross-sectional view taken along line XIB-XIB of FIG. 10B.

Because the third width W3 of the cavity 230 is less than the first width W1, as the cover member 200 is slid towards the bracket member 100, the distal end 221 of the sidewall 220 will contact the front surface 136 of the rod support member 130, thereby preventing the cover member 200 from being slid further towards the wall on which the bracket member 100 is mounted. FIG. 7A illustrates this best. Thus, while the first and second spring portions 151, 152 of the rod support member 130 are in the non-compressed state, the cover member 200 is prevented from being slid onto the bracket member 100. The first and second spring portions 151, 152 must first be compressed (altered into the compressed state), and only then can the cover member 200 be slid further towards the wall so that the rod support member 130 can enter into the cavity 230 of the cover member 200. There are arrows in FIGS. 6B, 7A, and 7B illustrating the compression force required to alter the first and second spring portions 151, 152 of the rod support member 130 into the compressed state.

Referring to FIGS. 8A-9B, the cover member 200 remains in the same position as it was in FIGS. 6A-7B, but the first and second spring portions 151, 152 of the rod support member 300 have been altered into the compressed state. That is, a force Z is applied onto the first and second spring portions 151, 152 of the rod support member 130 to alter the first and second spring portions 151, 152 into the compressed state (the force Z is shown with arrows in FIGS. 9A and 9B). As perhaps best seen in FIG. 9A, when the first and second spring portions 151, 152 are in the compressed state, the maximum width measured between the first and second spring portions 151, 152 (the width W2 shown in FIG. 9A) is less than the width W3 of the cavity 230 of the cover member 200. Thus, once the first and second spring portions 151, 152 are altered into the compressed state, the cover member 200 can continue to be slid towards the wall or support structure upon which the bracket member 100 is mounted.

Referring to FIGS. 10A-11B, the process continues whereby the cover member 200 is again slid towards the support structure or wall upon which the bracket member 100 is mounted. In other words, the cover member 200 is slid along the support rod 300 towards the base portion 110 of the bracket member 100. As noted above, the cover member 200 can only be moved or slid onto the rod support member 130 when the first and second spring portions 151, 152 thereof are in the compressed state. Thus, in FIGS. 10A-11B, the first and second spring portions 151, 152 remain in the compressed state. This is achieved by applying the compression force Z onto the first and second spring portions 151, 152 until at least a portion of the rod support member 130 is disposed within the cavity 230 of the cover member 200. Once a portion of the rod support member 130 is disposed within the cavity 230 of the cover member 200, engagement between the distal ends 158, 160 of the first and second spring portions 151, 152 and the inner surface 222 of the sidewall 220 of the cover member 200 maintains the first and second spring portions 151, 152 in the compressed state. That is, the first and second spring portions 151, 152 are unable to extend or restore back to their natural, fully non-compressed state while the rod support member 130 is disposed within the cavity 230 of the cover member 200.

To reiterate the above, once the rod support member 130 is disposed within the cavity 230 of the cover member 200, the first and second spring portions 151, 152 of the rod support member 130 exert an outward force X onto the inner surface 222 of the sidewall 220 of the cover member 200 as the first and second spring portions 151, 152 attempt to return to their natural state. The outward force X applied by the first and second spring portions 151, 152 onto the inner surface 222 of the sidewall 220 achieves a coupling between the bracket member 100 and the cover member 200. The outward force X applied by the first and second spring portions 151, 152 is the spring force or restoring force of the first and second spring portions 151, 152 as the first and second spring portions 151, 152 act to restore to their equilibrium positions shown in solid lines in FIG. 3 (i.e., the non-compressed or natural state).

It is important to again note that the first and second spring portions 151, 152 are able to operate as springs in the manner described herein due to the fact that the first and second spring portions 151, 152 of the rod support member 130 are not attached or joined to the base portion 110 of the bracket member 100. Specifically, because the first and second spring portions 151, 152 form cantilevers that extend from the support portion 140 of the rod support member 130 without being attached in any way to the base portion 110 of the bracket member 100, the first and second spring portions 151, 152 are able to be compressed/deformed/flexed relative to the support portion 140 of the rod support member 130. The lack of any attachment between the first and second spring portions 151, 152 and the base portion 110 provides the first and second spring portions 151, 152 with the flexibility described herein which enables the first and second spring portions 151, 152 to be compressed from their natural state into their compressed state, while exerting an outward restoring force when in the compressed state to facilitate coupling of the bracket member 100 to the cover member 200.

Figure 12:
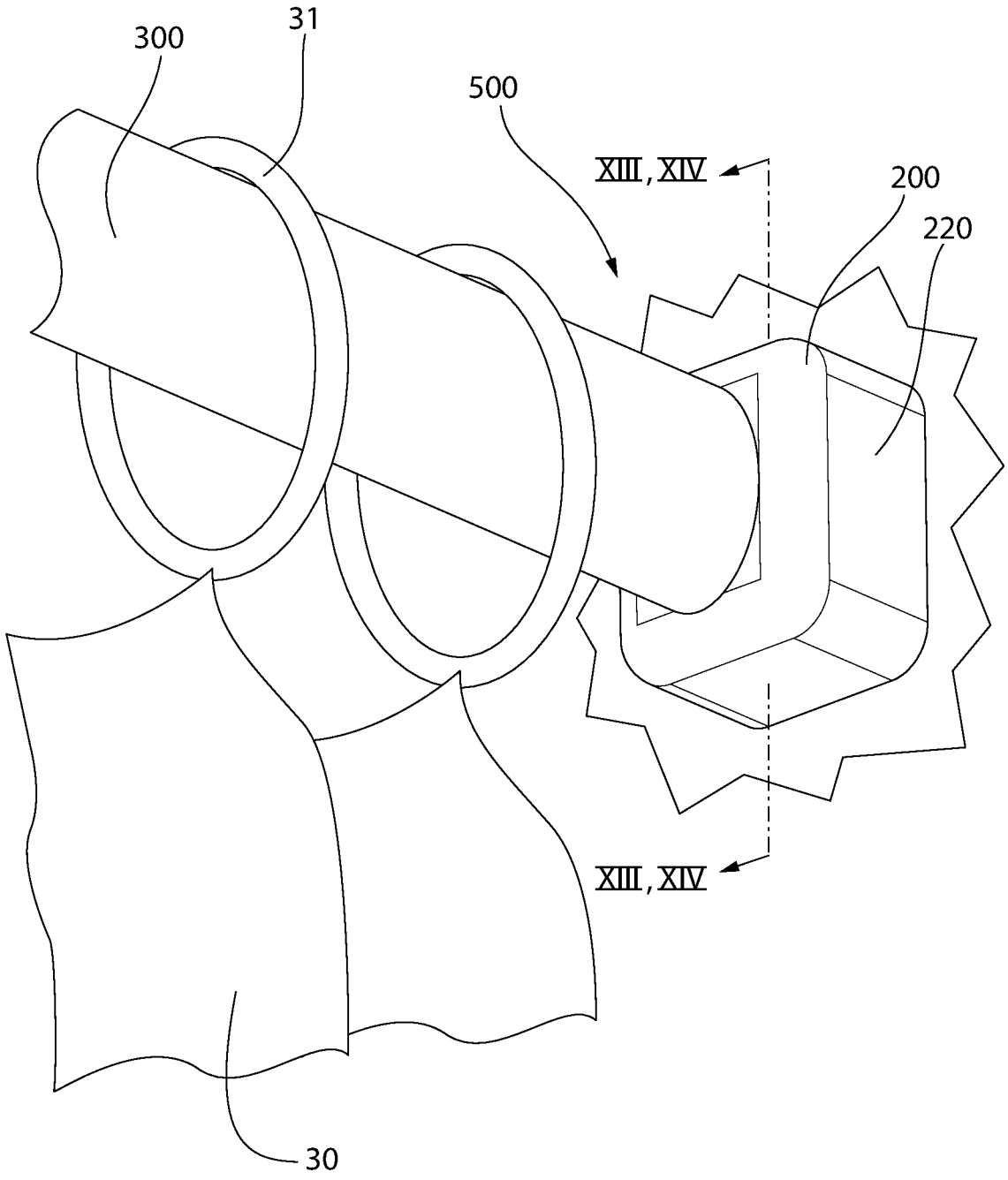
FIG. 12 is a rear perspective view illustrating the bracket member supporting the support rod and the cover member coupled to the bracket member.

FIG. 12 is a rear perspective view illustrating the bracket system 500 in an assembled state such that the cover member 200 is coupled to the bracket member 100 in the manner described above. The bracket member 100 is not visible in FIG. 12, but it should be apparent that the first and second spring members 151, 152 of the bracket member 100 are exerting an outward restoring force onto the inner surface 222 of the sidewall 221 of the cover member 200 to retain the cover member 200 in position.

Figure 14:
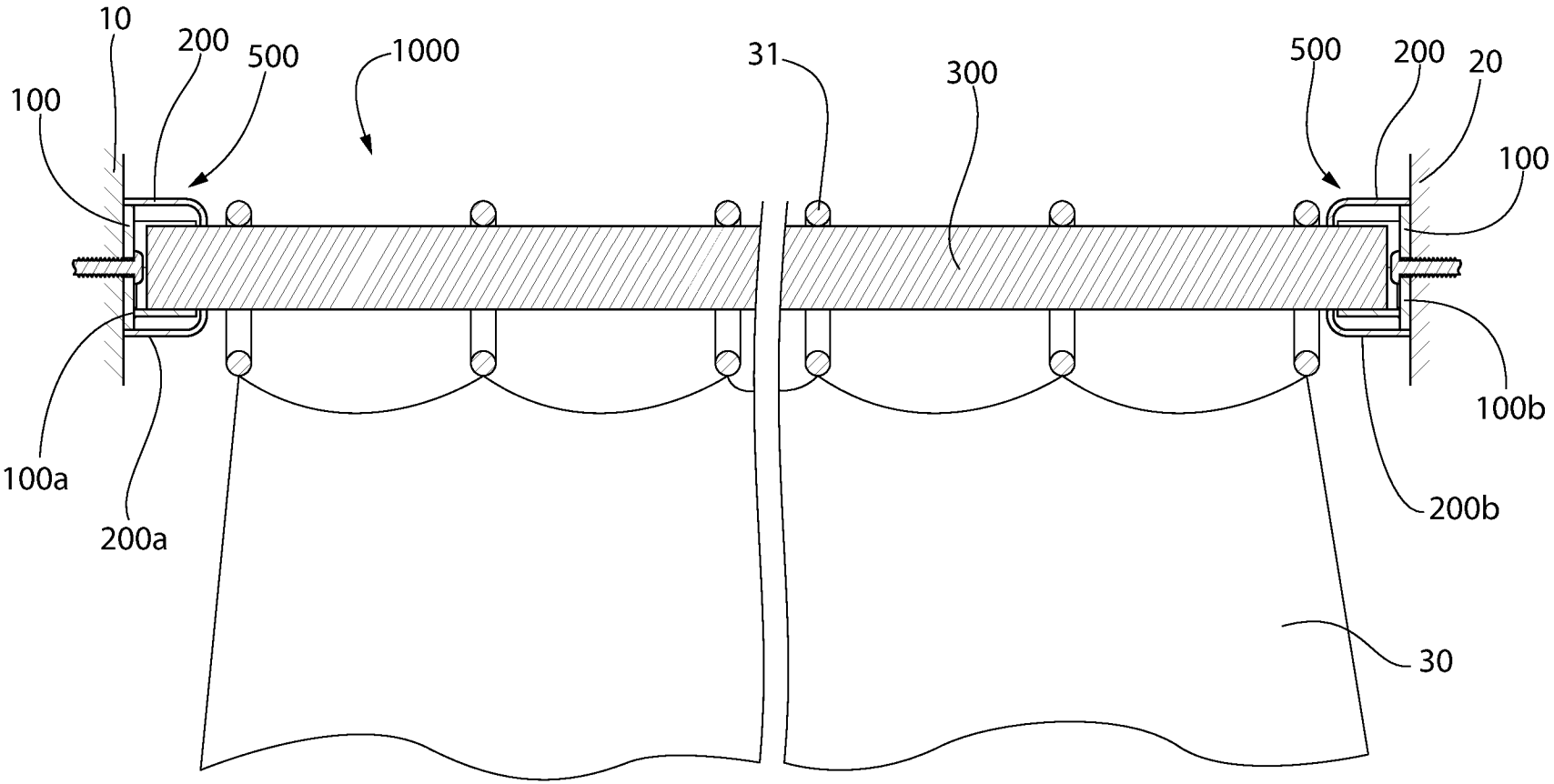
FIG. 14 is a cross-sectional view taken along line XIV-XIV of FIG. 12.

Turning to FIG. 13, a cross-sectional view of the rod assembly 1000 which includes the bracket system 500 and the support rod 300 is provided. As can be seen, the bracket member 100 is coupled to the wall 10 with the fastener 10 which extends through the mounting hole 113 and into the wall 10. The support rod 300 rests atop of the support portion 140 of the rod support member 130. The cover member 200 is slid onto the bracket member 100 until the distal end 221 of the sidewall 220 of the cover member 200 abuts against the wall 10. Thus, the entirety of the bracket member 100 is positioned within the cavity 230 of the cover member 200 and no portion of the bracket member 100 is visible, which provides for a clean aesthetic. The support rod 300 extends through the opening 215 in the cover member 200. And, as noted above, this same structure is repeated at the opposite end of the support rod 300 with another identical bracket system 500 coupled to another wall which faces the wall 10, as shown in FIG. 14 and described above.

As mentioned above, in the exemplified embodiment the distal end 221 of the sidewall 220 of the cover member 200 abuts against the support structure or wall 10. However, the invention is not to be so limited in all embodiments and the cover member 200 may instead be designed so that the distal end 221 of the sidewall 220 of the cover member 200 abuts against the front surface 111 of the base portion 110 of the bracket member 100. Thus, modifications such as this are possible and still fall within the scope of the claimed invention.

Due to the location at which the section of FIG. 13 is taken, the spring portions 151, 152 of the bracket member 100 are not visible. However, as has been described in detail above, the spring portions 151, 152 exert a restoring force onto the cover member 200 to hold the cover member 200 in place and thereby couple the cover member 200 to the bracket member 100. This is because the first and second spring portions 151, 152 must be compressed or altered into a compressed state or a compressed position prior to inserting the rod support member 130 into the cavity 230 of the cover member 200. Once the first and second spring portions 151, 152 are in the compressed state, the first and second spring portions 151, 152 will exert the restoring force until the first and second spring portions 151, 152 return to their natural, non-compressed state. However, while the rod support member 130 is positioned in the cavity 230 of the cover member 200, the first and second spring portions 151, 152 are forced to remain in a slightly compressed state due to the relative dimensions of the cavity 230 and the first and second spring portions 151, 152. This ensures that the restoring force is applied while the rod support member 130 of the bracket member 100 is located in the cavity 230 of the cover member 200 to maintain the coupling between the bracket member 100 and the cover member 200.

Figure 17:
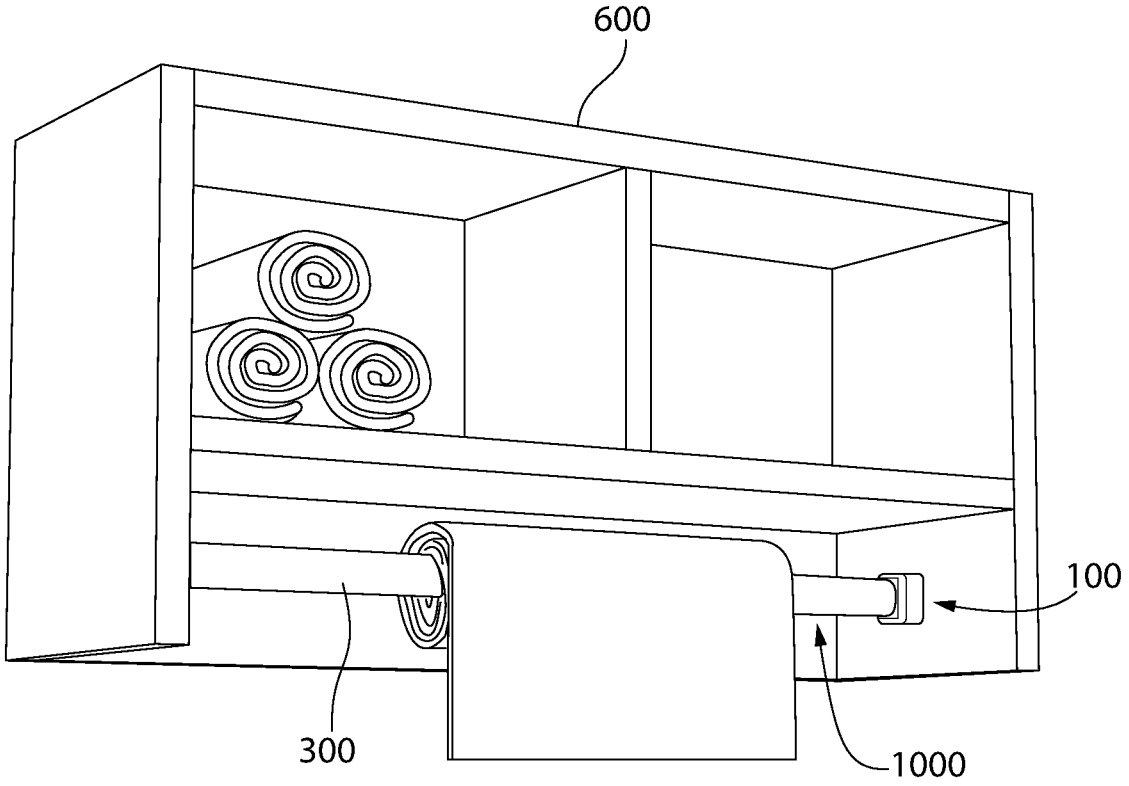
FIG. 17 is a perspective view of the rod assembly of FIG. 1 being used as a towel bar in accordance with an embodiment of the present invention.

Referring to FIG. 17, another embodiment is provided whereby the rod assembly 1000 is used as a towel bar within a cubby cabinet 600. Specifically, the cubby cabinet 600 includes an upper portion comprising two cubbies and a lower portion including two vertical support surfaces or walls. The bracket members 100 are mounted onto to opposing and facing vertical support surfaces or walls, and the rod member 300 extends between the two vertical support surfaces or walls. In still other embodiments, the rod assembly 1000 could be mounted between the legs of a sink vanity, between a vanity and an adjoining wall (with one bracket member 100 mounted to the sink vanity and the other bracket member 100 mounted to the wall and the rod member 300 extending between the sink vanity and the wall). Thus, variations in the end use for the rod assembly 1000 still fall within the scope of the invention described and claimed herein.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents. In addition, all combinations of any and all of the features described in the disclosure, in any combination, are part of the invention.

What is claimed is:

1. A bracket system for supporting a support rod, the bracket system comprising:

a bracket member configured to be mounted to a support structure, the bracket member comprising:

a base portion comprising a longitudinal axis, a rear surface that faces the support structure when the bracket member is coupled to the support structure, and a front surface opposite the rear surface; and a rod support member extending from the front surface of the base portion, the rod support member comprising a support portion and first and second spring portions that extend from the support portion on opposite sides of the longitudinal axis of the base portion, the support portion being attached to the front surface of the base portion and the first and second spring portions being unattached to the base portion so that the first and second spring portions can flex relative to the support portion; and a cover member configured for detachable coupling to the bracket member via engagement between the first and second spring portions of the rod support member of the bracket member and an inner surface of the cover member.

2. The bracket system according to claim 1 wherein the base portion comprises a top edge portion, a bottom edge portion, a first side edge portion, and a second side edge portion, the support portion of the rod support member comprising a concave upper surface that faces the top edge portion of the base portion and a convex lower surface that faces the bottom edge portion of the base portion, the first spring portion comprising a concave surface that faces the first side edge portion of the base portion and the second spring portion comprising a concave surface that faces the second side edge portion of the base portion.

3. The bracket system according to claim 1 wherein the rod support member is a monolithic and integral structure comprising the support portion and the first and second spring portions.

4. The bracket system according to claim 1 wherein when the cover member is coupled to the bracket member, the first and second spring portions are compressed inwardly towards the longitudinal axis of the base portion and the first and second spring portions apply a restoring force onto the cover member to retain the cover member and the bracket member in a coupled state.

5. The bracket system according to claim 1 wherein the first and second spring portions are alterable between: (1) a natural state whereby no force is applied onto the first and second spring portions and a distal portion of the first spring portion protrudes beyond a first side edge portion of the base portion and a distal portion of the second spring portion protrudes beyond a second side edge portion of the base portion; and (2) a compressed state whereby the first and second spring portions are compressed inwardly towards the longitudinal axis so the distal portion of the first spring portion is located inward of the first side edge portion of the base portion and the distal portion of the second spring portion is located inward of the second side edge portion of the base portion, and wherein the cover member is capable of being coupled to the bracket member when the first and second spring portions are in the compressed state and is prevented from being coupled to the bracket member when the first and second spring portions are in the natural state.

6. The bracket system according to claim 1 wherein the first and second spring portions are alterable between: (1) a natural state whereby no force is applied onto the first and second spring portions and a first width is measured between a distal end of the first spring portion and a distal end of the second spring portion in a direction transverse to the longitudinal axis of the base portion; and (2) a compressed state whereby the first and second spring portions are compressed inwardly towards the longitudinal axis and a second width is measured between the distal end of the first spring portion and the distal end of the second spring portion in a direction transverse to the longitudinal axis of the base portion, the first width being greater than the second width, and wherein the cover member is prevented from being coupled to the bracket member when the first and second spring portions are in the natural state.

7. The bracket system according to claim 1 wherein the support portion of the rod support member is welded to the front surface of the base portion and the first and second spring portions of the rod support member are not welded or otherwise joined to the front surface of the base portion, which permits the first and second spring portions of the rod support member to flex relative to the support portion of the rod support member and relative to the base portion.

8. The bracket system according to claim 1 wherein the cover member comprises a front wall having a front surface and a rear surface, and a sidewall extending from the rear surface of the front wall, an inner surface of the sidewall forming the inner surface of the cover member, the rear surface of the front wall and the inner surface of the sidewall defining a cavity within which at least a portion of the bracket member is disposed when the cover member is coupled to the bracket member.

9. The bracket system according to claim 8 further comprising a hole formed through the front wall of the cover member from the front surface to the rear surface, wherein the support portion of the rod support member is configured to support a support rod that passes through the hole in the front wall of the cover member.

10. The bracket system according to claim 8 wherein the cover member comprises a longitudinal axis that is parallel to the longitudinal axis of the base portion when the cover member is coupled to the bracket member, wherein the cavity of the cover member has a first width measured in a direction transverse to the longitudinal axis of the cover member, wherein the rod support member has a second width measured between a distal end of the first spring portion of the rod support member and a distal end of the second spring portion of the rod support member in a direction transverse to the longitudinal axis of the base portion when the first and second spring portions are in a non-compressed state, and wherein the second width is greater than the first width so that the cover member cannot be slid over the first and second spring portions when in the non-compressed state.

11. The bracket system according to claim 10 wherein the first and second spring portions of the rod support member are altered into a compressed state by moving the first and second spring portions inwardly towards the longitudinal axis of the base portion prior to sliding the cover member over the first and second spring portions to insert the rod support member into the cavity of the cover member.

12. The bracket system according to claim 1 wherein the first and second spring portions of the rod support member are alterable between a non-compressed state and a compressed state by application of a force onto the first and second spring portions in a direction towards the longitudinal axis of the base portion, and wherein the first and second spring portions fit into a cavity of the cover member in the compressed state and do not fit into the cavity of the cover member in the non-compressed state.

13. The bracket system according to claim 1 further comprising a mounting hole formed through the base portion of the bracket member for receiving a fastener that is configured to couple the bracket member to the support structure.

14. The bracket system according to claim 1 wherein the rod support member of the bracket member comprises a lower surface and an upper surface, the lower surface being convex along the support portion of the rod support member and concave along the first and second spring portions of the rod support member, the upper surface being concave along the support portion of the rod support member and convex along the first and second spring portions of the rod support member.

15. The bracket system according to claim 1 wherein each of the first and second spring portions forms a cantilever that is fixed at one end thereof to the support portion of the rod support member and free of attachment to any other structure at any other location therealong.

16. The bracket system according to claim 1 wherein the base portion and the rod support member are separate components that are coupled together by welding the support portion of the rod support member to the base portion, the rod support member having a rear surface that faces the front surface of the base portion, and wherein the rear surface of the rod support member is joined to the front surface of the base portion along the support portion thereof but not along the first and second spring portions thereof.

17. A rod assembly comprising:

a first bracket member and a second bracket member, each of the first and second bracket members comprising a base portion having a front surface and a rear surface and a rod support member extending from the front surface of the base portion, the rod support member comprising a support portion that is attached to the front surface of the base portion and first and second spring portions that are unattached to the front surface of the base portion, wherein the first bracket member is configured to be coupled to a first vertical surface with the rear surface of the base portion facing the first vertical surface and the second bracket member is configured to be coupled to a second vertical surface with the rear surface of the base portion facing the second vertical surface;

a support rod extending between the first and second vertical surfaces and supported by the support portions of the rod support members of the first and second bracket members;

a first cover member and a second cover member positioned around the support rod, each of the first and second cover members comprising a front wall having a hole through which the support rod extends and a sidewall extending from the front wall; and wherein the first cover member is coupled to the first bracket member by compressing the first and second spring portions of the first bracket member inwardly towards one another and sliding the first cover member over the rod support member of the first bracket, the first and second spring portions of the first bracket member exerting an outward restoring force onto the sidewall of the first cover member to couple the first cover member to the first bracket member; and wherein the second cover member is coupled to the second bracket member by compressing the first and second spring portions of the second bracket member inwardly towards one another and sliding the second cover member over the rod support member of the second bracket, the first and second spring portions of the second bracket member exerting an outward restoring force onto the sidewall of the second cover member to couple the second cover member to the second bracket member.

18. The rod assembly according to claim 17 wherein a distal end of the sidewall of the first cover member defines an opening into a cavity of the first cover member and a distal end of the sidewall of the second cover member defines an opening into a cavity of the second cover member, and wherein the rod support member of the first bracket member cannot fit into the opening of the first cover member without first compressing the first and second spring members of the first bracket member, and wherein the rod support member of the second bracket member cannot fit into the opening of the second cover member without first compressing the first and second spring members of the second bracket member.

19. The rod assembly according to claim 17 wherein each of the first and second spring portions of each of the first and second bracket members forms a cantilever that is fixed at one end thereof to the support portion of the rod support member and free of attachment to any other structure at any other location therealong.

20. A method of mounting a rod assembly on a supporting structure, the method comprising:

attaching a first bracket member to a first vertical support surface, a first rod support member of the first bracket member extending from the first vertical support surface;

attaching a second bracket member to a second vertical support surface that is spaced from and parallel to the first vertical support surface, a second rod support member of the second bracket member extending from the second vertical support surface;

sliding a first cover member and a second cover member onto a support rod;

positioning the support rod onto support portions of the first and second rod support members so that the support rod extends between the first and second vertical support surfaces;

compressing a spring portion of the first rod support member and sliding the first cover member towards the first bracket member until the spring portion of the first rod support member nests within a first cavity of the first cover member, the spring portion of the first rod support member exerting an outward restoring force onto the first cover member to couple the first cover member to the first bracket member; and compressing a spring portion of the second rod support member and sliding the second cover member towards the second bracket member until the spring portion of the second rod support member nests within a second cavity of the second cover member, the spring portion of the second rod support member exerting an outward restoring force onto the second cover member to couple the second cover member to the second bracket member.

* * * * *